US012595581B2

(12) United States Patent
McHugh et al.

(10) Patent No.: US 12,595,581 B2
(45) Date of Patent: Apr. 7, 2026

(54) COPLANARITY IMPROVEMENT OF HIGH-RATE CU PILLAR PROCESSES USING HIGH AGITATION TO ENABLE USE OF HIGH ACID, LOW CU CHEMISTRIES

(71) Applicant: APPLIED Materials, Inc., Santa Clara, CA (US)

(72) Inventors: Paul R. McHugh, Kalispell, MT (US); Gregory J. Wilson, Kalispell, MT (US); John L. Klocke, Kalispell, MT (US)

(73) Assignee: APPLIED Materials, Inc., Santa Clara, CA (US)

( * ) Notice: Subject to any disclaimer, the term of this patent is extended or adjusted under 35 U.S.C. 154(b) by 40 days.

(21) Appl. No.: 18/660,111

(22) Filed: May 9, 2024

(65) Prior Publication Data

US 2025/0347022 A1 Nov. 13, 2025

(51) Int. Cl.
*C25D 5/34* (2006.01)
*C25D 3/38* (2006.01)

(52) U.S. Cl.
CPC ..... *C25D 5/34* (2013.01); *C25D 3/38* (2013.01)

(58) Field of Classification Search
None
See application file for complete search history.

(56) References Cited

U.S. PATENT DOCUMENTS 5,421,987 A * 6/1995 Tzanavaras ..... C25D 5/026 205/255
6,773,571 B1 * 8/2004 Mayer ..... C25D 7/123 204/286.1
2004/0084318 A1 * 5/2004 Cohen ..... C25D 7/123 257/E21.174
2006/0226018 A1 * 10/2006 Iwazaki ..... C25D 5/08 205/148
2017/0029400 A1 * 2/2017 Zhang ..... C07D 311/84
2020/0354851 A1 * 11/2020 Jia ..... C25D 17/12

* cited by examiner

*Primary Examiner* — Wojciech Haske
(74) *Attorney, Agent, or Firm* — CHRISTENSEN O'CONNOR JOHNSON KINDNESS PLLC

(57) ABSTRACT

An electroplating system including a Cu bath disposed within a vessel, the Cu bath characterized by a predetermined threshold of Cu concentration, and a predetermined threshold of acid concentration, and where a substrate is submerged in the Cu bath; and a jet array configured to spray a fluid onto the substrate, where the fluid has a same composition as the Cu bath. Further, a method including spraying a fluid onto a substrate with the jet array, wherein the fluid has a same composition as the Cu bath and where spraying the substrate increases a deposition rate of a deposited Cu onto the substrate, where the predetermined threshold of acid concentration increases a bath conductivity of the Cu bath, and where the increased bath conductivity improves a coplanarity of deposited copper structure.

16 Claims, 13 Drawing Sheets

COPLANARITY IMPROVEMENT OF HIGH-RATE CU PILLAR PROCESSES USING HIGH AGITATION TO ENABLE USE OF HIGH ACID, LOW CU CHEMISTRIES

TECHNICAL FIELD

The present technology relates to methods, components, and apparatuses for semiconductor manufacturing. More specifically, the present technology relates to electroplating components and other semiconductor processing equipment.

BACKGROUND

Microelectronic devices, such as semiconductor devices, are fabricated on and/or in wafers or workpieces. A typical wafer plating process involves depositing a metal seed layer onto the surface of the wafer via vapor deposition. A photoresist may be deposited and patterned to expose the seed layer. The wafer is then moved into the vessel of an electroplating processor where electric current is conducted through a fluid to the wafer, to deposit a blanket layer or patterned layer of a metal or other conductive material onto the seed layer. Examples of conductive materials include permalloy, gold, silver, copper, cobalt, tin, nickel, and alloys of these metals. Subsequent processing steps form components, contacts and/or conductive lines on the wafer. Many aspects of an electroplating process may impact process uniformity, such as irregularities in the electric field due to pattern variations, mass-transfer rates, deposition rates, as well as other process and component parameters. Even minor discrepancies across a substrate may impact downline finishing processes.

Thus, there is a need for improved systems and methods that can be used to produce high quality devices and structures. These and other needs are addressed by the present technology.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

Disclosed herein is an electroplating system for a substrate, including a Cu bath disposed within a vessel, the Cu bath being characterized by a predetermined threshold of Cu concentration and a predetermined threshold of acid concentration, where the substrate is submerged in the Cu bath, and a jet array configured for increasing a strain rate of a fluid being sprayed onto the substrate, where the fluid has a same composition as the Cu bath.

In some embodiments, the predetermined threshold of Cu concentration is between about 10 grams/Liter to about 60 grams/Liter. In some embodiments, the predetermined threshold of Cu concentration is between about 40 grams/Liter to about 60 grams/Liter.

In some embodiments, the jet array is configured to spray fluid with a strain rate of about 5,000 to about 30,000 per second. In some embodiments, the jet array comprises a plurality of apertures disposed on a plate. In some embodiments, the jet array sprays the fluid at a flow rate of about 0.01 gpm to about 0.05 gpm per aperture of the plurality of apertures. In some embodiments, the plate is a first plate and the plurality of apertures is a first plurality of apertures, and where the jet array further comprises a second plate coupled with the first plate on a bottom side of the first plate, and a second plurality of apertures, where an outlet end of each of the first plurality of apertures and each of the second plurality of apertures extends through a top surface of the first plate, an inlet end of each of the first plurality of apertures extends through a bottom surface of the first plate, and an inlet end of each of the second plurality of apertures extends through a bottom surface of the second plate.

In some embodiments, a diameter of each of the plurality of apertures is no greater than 1 mm.

Also disclosed herein is method of electroplating by an electroplating system, the system comprising a spray jet array, and a copper (Cu) bath, where the Cu bath is characterized by a predetermined threshold of Cu concentration, and a predetermined threshold of acid concentration, the method including spraying a fluid onto a substrate with the jet array, where the fluid has a same composition as the Cu bath and where spraying the substrate increases a deposition rate of a deposited Cu onto the substrate, and depositing Cu onto the substrate while the jet array is spraying the Cu bath, where the predetermined threshold of acid concentration increases a bath conductivity of the Cu bath, and where the increased bath conductivity improves a coplanarity of copper structures being deposited on the substrate.

In some embodiments, the predetermined threshold of Cu concentration is between about 10 grams/Liter to about 60 grams/Liter. In some embodiments, the Cu bath conductivity is between about 400 mS/cm and about 800 mS/cm. In some embodiments, the predetermined threshold of Cu concentration is between about 40 grams/Liter to about 60 grams/Liter.

In some embodiments, the method further includes depositing Cu until a target deposit is reached. In some embodiments, the target deposit is between about 10 μm and about 100 μm. In some embodiments, the deposited Cu has an aspect ratio of about 0.4 to about 20.

In some embodiments, the jet array sprays the fluid at a strain rate of about 5,000 to about 30,000 per second.

In some embodiments, the electroplating system further comprises a head that is configured to hold the substrate, and the method further includes placing the substrate onto the head, submerging the substrate in the Cu bath, and positioning the head to a plating position.

In some embodiments, the jet array comprises a plurality of apertures disposed on a plate. In some embodiments, the jet array sprays the fluid at a flow rate of about 0.01 gpm to about 0.05 gpm per aperture of the plurality of apertures. In some embodiment, the plate is a first plate and the plurality of apertures is a first plurality of apertures, and where the jet array further includes a second plate coupled with the first plate on a bottom side of the first plate, and a second plurality of apertures, where an outlet end of each of the first plurality of apertures and each of the second plurality of apertures extends through a top surface of the first plate, an inlet end of each of the first plurality of apertures extends through a bottom surface of the first plate, and an inlet end of each of the second plurality of apertures extends through a bottom surface of the second plate, and where the method further includes spraying the substrate with jets formed through only the first plurality of apertures, ceasing to spray the substrate with jets formed through the first plurality of apertures, and spraying the substrate with jets formed through only the second plurality of apertures.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1A:
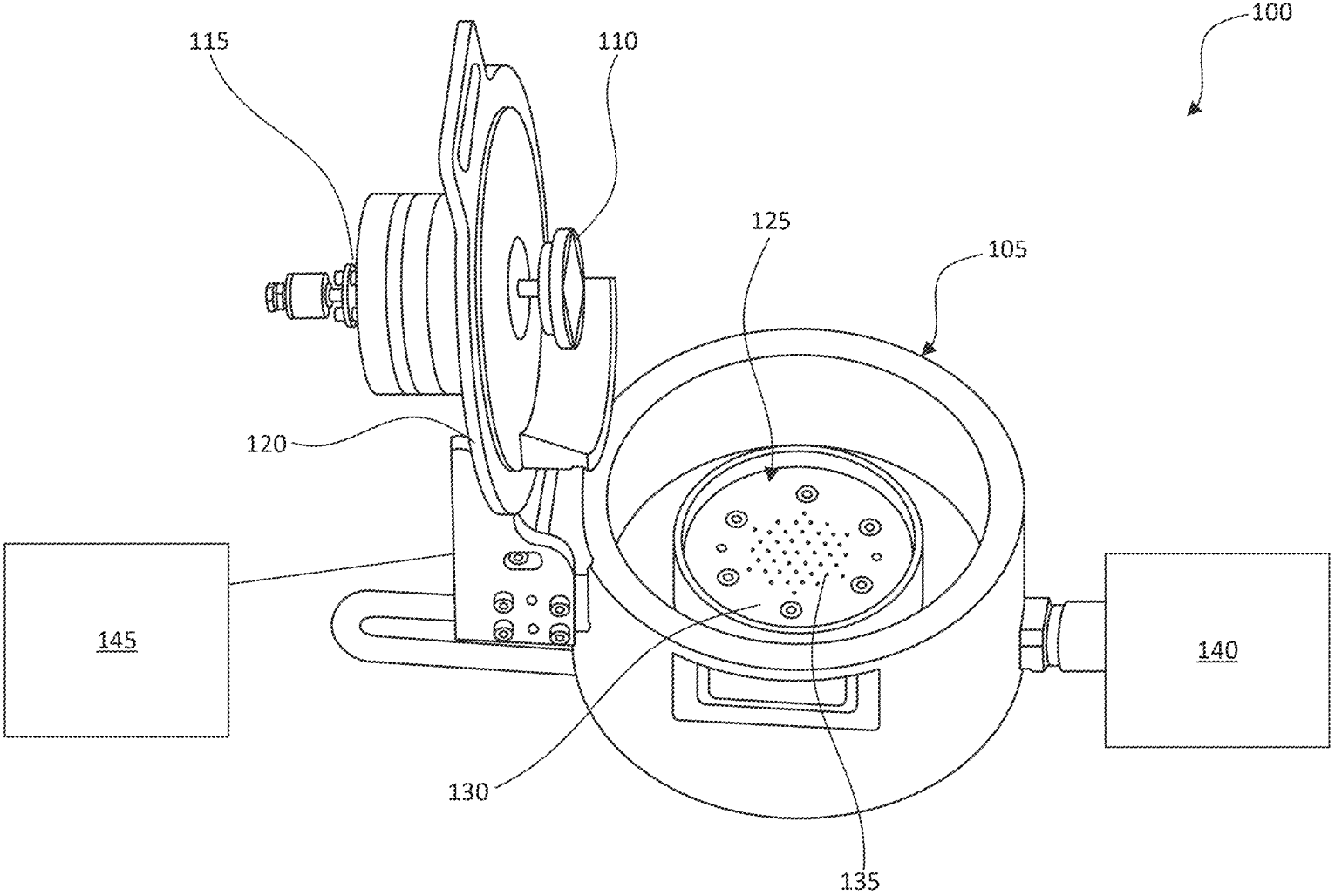
FIG. 1A shows an isometric view of an exemplary electroplating system according to some embodiments of the present technology.

In many or most electroplating applications, it is important that the plated film or layer(s) of metal have a uniform thickness across the wafer or workpiece. Non-uniformities can be caused by irregularities in the electric field due to pattern variations, by mass-transfer rates, and/or other factors. For example, co-planarity issues may arise when a substrate has regions that have different feature depths and in particular with regions that have deep features, such as trenches. Co-planarity is worsened by regions that have different open areas. Co-planarity is worsened in patterns with deep features if mass-transfer rates to the substrate are too low or non-uniform. Conventional systems may attempt to improve such co-planarity issues by reducing current applied to the Cu bath to gradually fill deep features before later increasing the current. However, such operations may introduce additional complexity, time, and/or cost into the electroplating operation and/or may cause other issues in the electroplating process. Additionally, conventional plating systems use paddle-based electrolyte agitation devices to increase the strain rate on the wafer surface, which is correlated to plating rate in deep features. However, such paddle agitation is limited to producing strain rates in the range of between 3,000 to 4,000 per second. Such strain rates limit the plating rate in deep features and limit the throughput of the plating system.

The present technology relies on a submerged spray jet array that sprays a number of pressurized jets of electrolyte against the wafer. Such jet arrays may increase the strain rate by approximately an order of magnitude over conventional systems. For example, embodiments of the present technology may provide strain rates of between about 5,000 and 30,000 per second. These enhanced strain rates may improve the mass transfer rate to enable higher deposition rates. Additionally, the higher strain rate may be more effective at filling deep features and/or other complicated wafer features, which enables the plating process at higher current levels throughout the entire plating operation. The use of higher current levels may further improve the efficiency and throughput of the plating system. Accordingly, the present technology may increase plating efficiency (i.e., deposition rate) and, in some cases, may improve co-planarity of substrates during electroplating operations.

Further, deposition rates at the bottom of pillars on a substrate decrease with the depth of the pillar. The maximum Copper (Cu) deposition rate is directly proportional to Cu concentration. Furthermore, electrical conductivity of the Cu bath increases with acid concentration. However, higher Cu concentration also operates to lower the acid concentration of the Cu bath, therefore generally decreasing acid concentration, leading to undesired decrease in electrical conductivity of the Cu bath. Cu solubility is lower for higher acid baths. Consequently, increasing the Cu concentration often requires reducing the bath acid concentration. Bath conductivity is primarily dependent upon the acid concentration. Thus, the two beneficial Cu bath conditions (i.e., increased Cu concentration and increased acid concentration) operate to cancel or at least limit each other's benefits. In practical terms, the concentration of Cu in the bath is limited to avoid an excessive impact on the electrical conductivity of the Cu bath (i.e., a lower acid concentration). To counteract these mutually limiting effects of Cu concentration and acid concentration, in some embodiments, Cu deposition rate may be increased by higher agitation of the bath fluid (i.e., spraying fluid jets of the Cu bath over the target area of the wafer with a jet array). Advantageously, the devices, systems, and methods described herein can compensate for a lower Cu concentration of a Cu bath with an increase in agitation (e.g., an increase in strain rate or flow rate of the fluid generated by the jet array). In some embodiments, the effect of increase in agitation is proportionally larger than the effect of decrease in Cu concentration. Therefore, the technology described herein is capable of improving coplanarity with a higher conductivity fluid, without the need for a higher Cu concentration.

In some embodiments, disclosed herein is an electroplating system including a jet array and a Cu bath. The Cu bath is characterized by a predetermined threshold of Cu concentration, and a predetermined threshold of acid concentration. As described herein, the predetermined threshold for Cu concentration is a low Cu concentration, such as between about 20 g/L to about 60 g/L. In some embodiments, the predetermined threshold for Cu concentration is about 10 g/L to about 100 g/L. In some embodiments, the predetermined threshold for Cu concentration is about 40 g/L to about 60 g/L. The predetermined threshold of acid concentration is a high acid concentration, such as between about 100 grams/Liter to about 220 grams/Liter. But at around 220 grams/L, there may be issues with Cu solubility which may drop down to 40 grams/L. Some examples of acids used in the Cu bath include sulfuric acid, sulfamic acid, and the like. In some embodiments, the jet array is configured to spray a fluid as a jet within the Cu bath, where the fluid has a same composition of the Cu bath. In such embodiments, a substrate may be submerged in the Cu bath as the jet array sprays the substrate with the fluid (i.e., with the Cu bath).

In some embodiments, disclosed herein is a method of improving coplanarity, including spraying a fluid onto a substrate with the jet array, wherein the fluid has a same composition as the Cu bath (e.g., the fluid being sprayed by the jet array comes from the Cu bath itself). Spraying the substrate increases a deposition rate of a deposited Cu onto the substrate, where the predetermined threshold of acid concentration increases bath conductivity of the Cu bath, and where the increased bath conductivity improves a coplanarity of the semiconductor device.

Although the remaining disclosure will routinely identify specific electroplating processes utilizing the disclosed technology, it will be readily understood that the systems and methods are equally applicable to other plating chambers and systems, as well as processes as may occur in the described systems. Accordingly, the technology should not be considered to be so limited as for use with these specific plating processes or systems alone. The disclosure will discuss one possible system that may include electroplating components according to embodiments of the present technology before additional variations and adjustments to this system according to embodiments of the present technology are described.

Figure 1B:
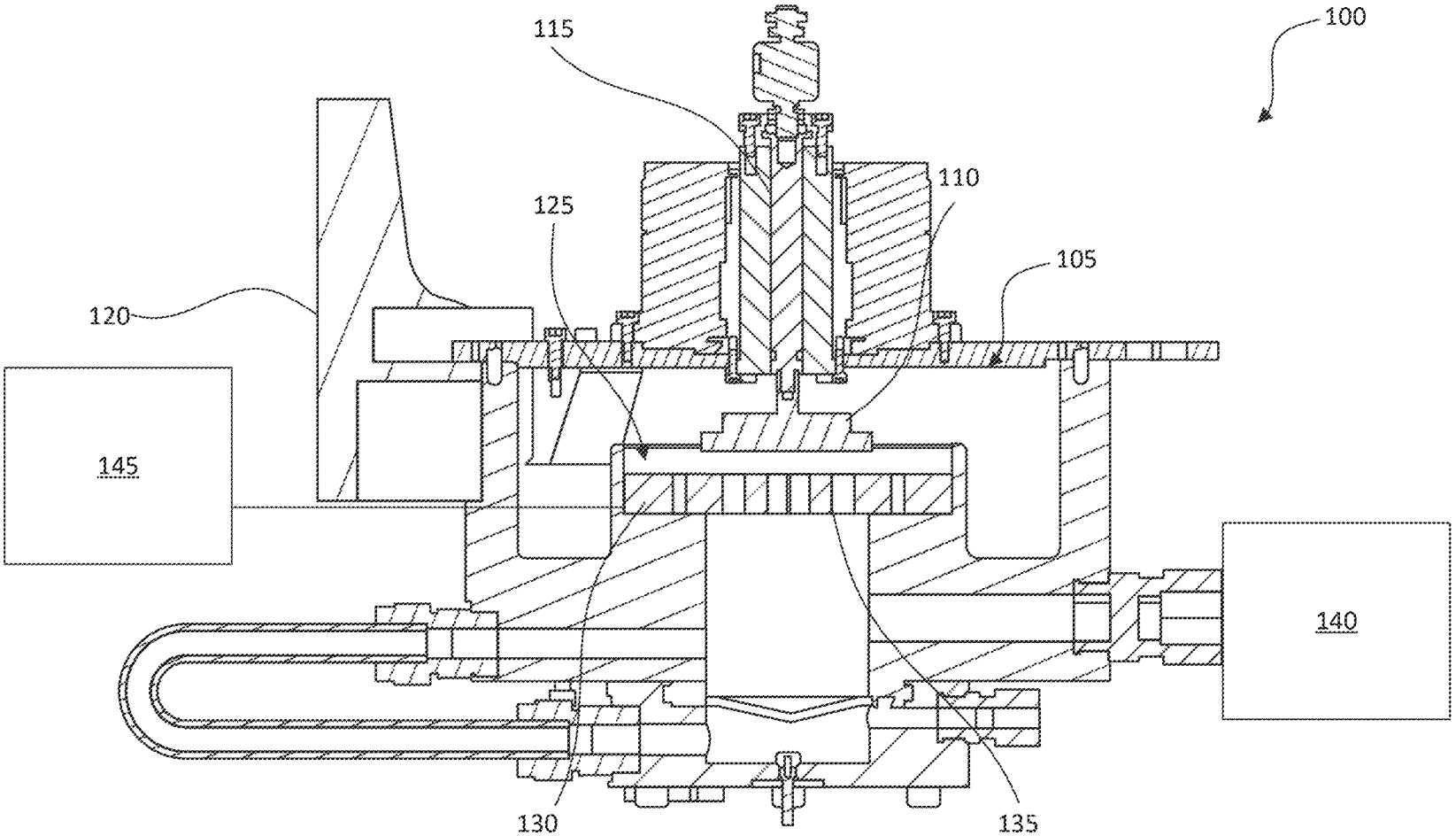
FIG. 1B shows a cross-sectional side elevation view of the system of FIG. 1A.

FIG. 1A shows an isometric view of an exemplary electroplating system according to some embodiments of the present technology. FIG. 1B shows a cross-sectional side elevation view of the system of FIG. 1A. FIGS. 1A and 1B illustrate an exemplary system 100 for electroplating a substrate, such as a semiconductor substrate, according to embodiments of the present technology. A single system 100 may be used as a standalone unit. Alternatively, multiple systems 100 may be provided in arrays within an enclosure, with substrates or workpieces loaded and unloaded into and out of the processors by one or more robots. System 100 may include a vessel 105 that may hold a fluid (also referred to herein as a "liquid electrolyte solution") for use in plating operations. System 100 may include a head 110 that is configured to hold a substrate that is to be plated. For example, head 110 may include a contact ring that may hold a substrate against head 110. The contact ring may include a number of contact fingers that may make electrical contact with a conductive layer, such as a metal seed layer, on the substrate. The contact ring may optionally have a seal to seal the contact fingers from the fluid. Head 110 may include and/or be coupled with a rotor 115 that may rotate the substrate during processing. Rotation of the substrate may help even out mass transfer rates by reducing the likelihood that one or more locations are exposed to greater current density and/or fluid flow than other locations. In some embodiments, the contact ring may be coupled with rotor 115, which may enable the contact ring to rotate along with rotor 115. In some embodiments, the contact ring may include a seal and a backing plate, with the contact ring and the backing plate forming a substrate holder.

Head 110 may be positioned within an interior of vessel 105. For example, head 110 may be supported by a head lifter 120 that is coupled with vessel 105. Head lifter 120 may lift and/or invert head 110 into an open position to load and unload a substrate. Head lifter 120 may also lower the head 110 to a plating position in which head 110 may be inserted within the interior of vessel 105 and engaged with one or more components of vessel 105 for processing of the substrate. As illustrated, head lifter 120 pivots about an axis to move head 110 between the open and plating positions, however other movement mechanisms may be utilized in various embodiments. In the plating position, a bottom portion of head 110 may be submerged within the Cu bath. For example, the Cu bath may extend beyond a top surface of the substrate, such as by being extending above the top surface of the substrate by up to 25 mm, up to 20 mm, up to 15 mm, up to 10 mm, up to 5 mm, up to 4 mm, up to 3 mm, up to 2 mm, up to 1 mm, or less. Other depths may be possible in various embodiments.

Head 110 may be movable to position the substrate holder into the plating position in vessel 105 in which the seed layer may be in contact with the Cu bath in vessel 105. Electrical control and power cables (not shown) may be linked to the lift/rotate weir shield and to internal head components lead up from system 100 to facility connections, or to connections within multi-processor automated system. A rinse assembly may be included and may have tiered drain rings that may be provided above and/or about vessel 105 in some embodiments.

System 100 may include a submerged spray jet array 125 that is disposed within the interior of vessel 105. Spray jet array 125 may be mounted within vessel 105 at a position below head 110, when head 110 is in the plating position. Spray jet array 125 may include a plate 130 that defines a plurality of apertures 135 through a thickness of plate 130. A volume of the fluid may be passed through apertures 135 to create a number of pressurized jets of fluid that impinge on the substrate to increase the strain rate, and subsequently the mass transfer rate, of plating material on the substrate relative to traditional electrolyte (fluid) agitation techniques (e.g., using agitation paddles). For example, system 100 may include one or more fluid pumps 140 that may be fluidly coupled with an inlet end of each of the apertures 135 and may deliver fluid to apertures 135 to generate the pressurized jets. Fluid pumps 140 may be configured to deliver the fluid at flow rates sufficient to generate the pressurized jets. For example, the fluid pump 140 may flow the fluid at a rate of at least 10 gallons per minute, at least 15 gallons per minute, at least 20 gallons per minute, at least 25 gallons per minute, at least 30 gallons per minute, at least 35 gallons per minute, at least 40 gallons per minute, at least 45 gallons per minute, at least 50 gallons per minute, at least 55 gallons per minute, at least 60 gallons per minute, or more. Spray jet array 125 may be submerged within the Cu bath that is contained within vessel 105. Submerging spray jet array 125 within the Cu bath may ensure that the pressurized jets provide constant current delivery paths to the substrate and do not generate any air bubbles to reach the substrate that could cause defects to form on the substrate. In some embodiments, spray jet array 125 and head 110 may be positioned such that outlet ends of each aperture 135 are within 25 mm of a bottom surface of 110 head, within 20 mm of the bottom surface, within 15 mm of the bottom surface, within 10 mm of the bottom surface, within 8 mm of the bottom surface, within 7 mm or the bottom surface, within 6 mm of the bottom surface, within 5 mm of the bottom surface, or less.

In some embodiments, there may be mass transfer uniformity issues, particularly proximate the center of the substrate. More specifically, while rotation of head 110 and the substrate during plating may ensure that the pressurized jets impinge about different regions of the substrate, if a centermost jet is coaxial with the center of rotation of head 110, the central most jet will remain in a same position relative to the substrate, which may lead to increased mass transfer rates near the center of the substrate. Different techniques may be used to mitigate such effects by better averaging the mass transfer rate across the surface of the substrate. For example, in some embodiments a center of rotation (e.g., rotational axis) of head 110 may be offset from a center of spray jet array 125. More specifically, head 110 and spray jet array 125 may be arranged relative to one another such that no single aperture 135/pressurized jet is aligned with the center of rotation of head 110. Where apertures 135 are arranged in a grid-like patten (e.g., in rows and/or columns) the offset between the center of rotation of head 110 and spray jet array 125 may be along an X-axis (e.g., a row of apertures 135), a Y-axis (e.g., a column of apertures 135), and/or both the X-axis and the Y-axis (e.g., at an angle between the X-axis and the Y-axis). An amount of the offset may be based on a pitch between adjacent apertures in some embodiments. For example, the distance of the offset may be less than about 1× of the pitch, less than or equal to 0.9× of the pitch, less than or equal to 0.8× of the pitch, less than or equal to 0.7× of the pitch, less than or equal to 0.6× of the pitch, less than or equal to 0.5× of the pitch, less than or equal to 0.4× of the pitch, less than or equal to 0.3× of the pitch, or less.

In some embodiments, head 110 and/or spray jet array 125 may be laterally translated relative to the other component, which may ensure that a central most aperture 135/pressurized jet does not remain in a same location relative to the center of the substrate during the entire plating operation. Head 110 and/or spray jet array 125 may be laterally translated along the X-axis, the Y-axis, and/or both the X-axis and the Y-axis (e.g., at an angle of 15°, 30°, 45°, 60°, 75°, etc.). An amount of the offset may be based on a pitch between adjacent apertures in some embodiments. For example, the distance of the offset may be less than about 1× of the pitch, less than or equal to 0.9× of the pitch, less than or equal to 0.8× of the pitch, less than or equal to 0.7× of the pitch, less than or equal to 0.6× of the pitch, less than or equal to 0.5× of the pitch, less than or equal to 0.4× of the pitch, less than or equal to 0.3× of the pitch, or less.

In some embodiments, an arrangement of apertures 135 on plate 130 may be designed to improve the uniformity of mass transfer rate across a surface of a substrate. For example, in some embodiments apertures 135 may be distributed at regular sizes and/or intervals/pitches across a substantial portion (e.g., at least 75%, at least 80%, at least 85%, at least 90%, at least 95%, or more) of plate 130, with a size and/or pitch between apertures 135 within a central region (e.g., inner 25%, inner 20%, inner 15%, inner 10%, inner 5%, or less) may be adjusted to combat mass transfer uniformity issues near a center of the substrate. For example, a pitch may be reduced (e.g., aperture density decreased) and/or a cross-sectional area of one or more apertures 135 may be increased within the central region of plate 130 to help reduce mass transfer rates within the central region to improve mass transfer rate uniformity across the surface of the substrate. For example, the larger apertures 135 may reduce jet velocity and subsequently lower the strain rate/mass transfer rate, while a smaller pitch may help provide better averaging of the mass transfer rate. In areas proximate the center of the substrate, the crossflow effect is less pronounced, which may enable the use of smaller aperture pitches in this region. It will be appreciated that any of the techniques of improving mass transfer rate uniformity may be used alone or in combination with other techniques to improve the mass transfer rate uniformity across the surface of the substrate.

System 100 may include one or more power sources 145 that may be operable to deliver current to spray jet array 125, which may enable fluid (electrolyte) formed through spray jet array 125, such as via apertures 135, to deliver current to the substrate. For example, system 100 may include an anode (not shown) below plate 130 and/or a membrane. Current supplied by power source 145 controls current flow from the anode to the cathode to plate the substrate. Due to the use of apertures 135 to conduct the current to the substate, apertures 135 may be substantially evenly distributed about plate 130 to help ensure that the current density across the substrate is substantially constant (e.g., uniform to within 15%, within 10%, within 5%, within 3%, within 1%, or less). In some embodiments, a secondary cathode (e.g., a thief electrode) may be used to improve uniformity at the edge of the substrate.

Figure 2A:
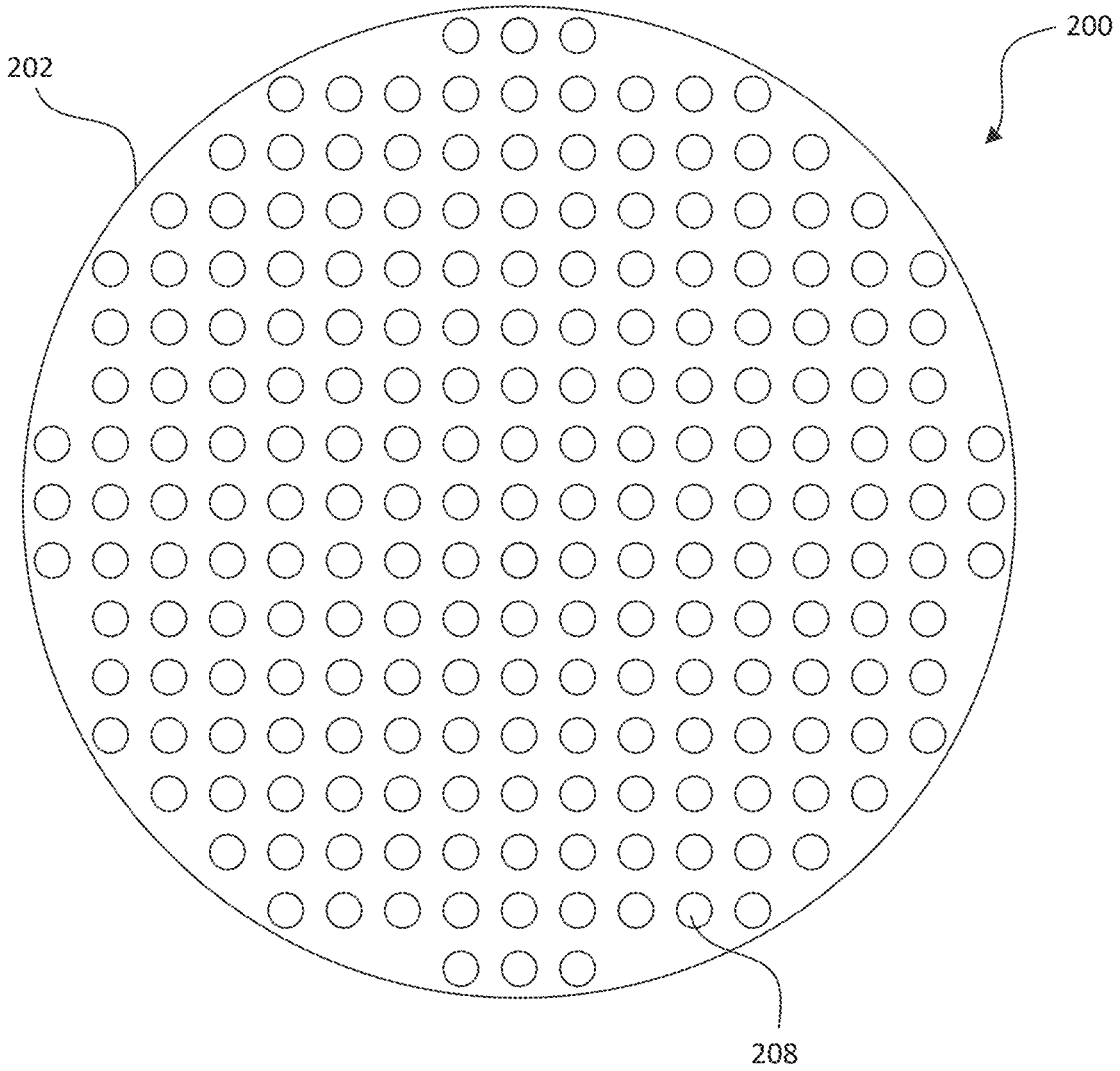
FIG. 2A shows a schematic top plan view of a spray jet array according to some embodiments of the present technology.
Figure 2B:
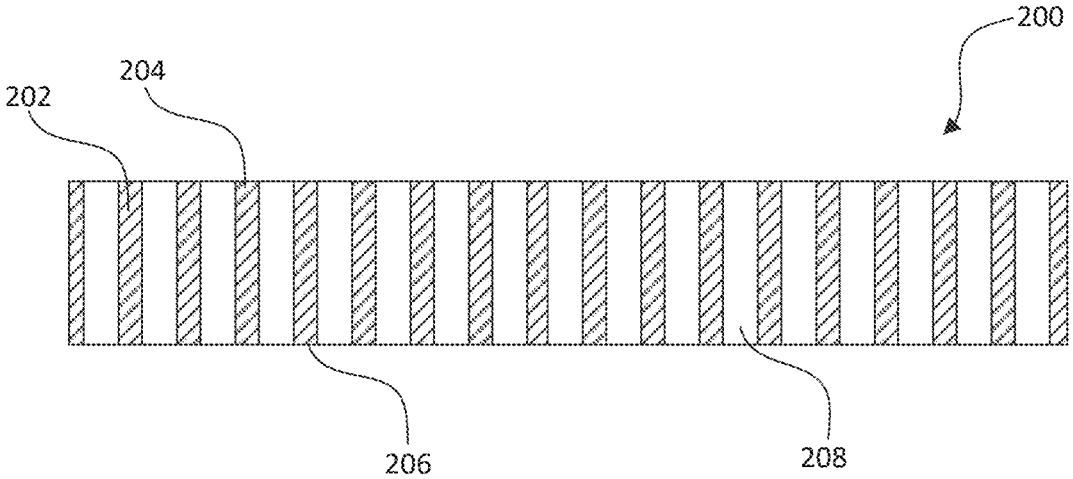
FIG. 2B shows a cross-sectional side elevation view of the spray jet array of FIG. 2A.

FIG. 2A shows a schematic top plan view of a spray jet array according to some embodiments of the present technology. FIG. 2B shows a cross-sectional side elevation view of the spray jet array of FIG. 2A. FIGS. 2A and 2B illustrate one embodiment of a spray jet array 200 according to some embodiments of the present technology. Spray jet array 200 may be used as a spray jet array within an electroplating system such as electroplating system 100, as well as any chamber or system that may benefit from spray jet array 200. For example, spray jet array 200 may be used as spray jet array 125 and may be positioned within an interior of a plating vessel below a substrate-carrying head. Spray jet array 200 may include a plate 202, which may be characterized by a first surface 204 (e.g., a top surface) and a second surface 206 (e.g., a bottom surface), which may be opposite first surface 204. Plate 202 may define a number of apertures 208 through plate 202 and extending from first surface 204 through second surface 206. Each aperture 208 may provide a fluid path through plate 202, with fluid passing through apertures 208 to form pressurized jets that may impinge on a substrate positioned within a head of an electroplating system. Apertures 208 may have generally cylindrical cross-sections in some embodiments. While shown here with each aperture 208 extending substantially perpendicular to first surface 204 and second surface 206, it will be appreciated that other aperture designs are possible. For example, some or all of apertures 208 may be at angles less than or greater than 90 degrees relative to first surface 204 and/or second surface 206. Non-perpendicular apertures 208 may be used at some or more locations to adjust the impingement angle of the resultant jets of fluid, which may enable plate 202 to mitigate radial fluid flow issues in some embodiments. In some embodiments, each aperture 208 may have a diameter (or other maximum lateral dimension) of no greater than 1 mm, no greater than 0.9 mm, no greater than 0.8 mm, no greater than 0.7 mm, no greater than 0.6 mm, no greater than 0.5 mm, or less, although other aperture sizes may be used in various embodiments. Smaller apertures 208 may produce jets of higher velocity and therefore produce higher strain rates on the substrate.

In some embodiments, a flow conductance through each aperture may be substantially equal. In other embodiments, one or more apertures 208 may have different flow conductance values. All or substantially all apertures 208 (e.g., at least 90%, at least 95%, at least 99%, all but one aperture (e.g., a centermost aperture), or all apertures) may have an equal or substantially equal (e.g., within 10%, within 5%, within 3%, within 1%, or less) flow conductance across the surface of plate 202. In other embodiments, apertures 208 may be arranged to provide variable flow conductance across a surface of plate 202. For example, in some embodiments apertures 208 may be distributed at regular sizes and/or intervals/pitches across a substantial portion (e.g., at least 75%, at least 80%, at least 85%, at least 90%, at least 95%, or more) of plate 130, with a size and/or pitch between apertures 208 within a central region (e.g., inner 25%, inner 20%, inner 15%, inner 10%, inner 5%, or less) of plate 202 being adjusted to combat mass transfer uniformity issues near a center of the substrate. For example, a pitch may be increased (e.g., aperture density decreased) and/or a cross-sectional area of one or more apertures 208 may be decreased within the central region of plate 202 to help reduce mass transfer rates within the central region to improve mass transfer rate uniformity across the surface of the substrate. In some embodiments, a pitch may be reduced (e.g., aperture density decreased) and/or a cross-sectional area of one or more apertures 208 may be increased within the central region of plate 202 to help reduce mass transfer rates within the central region to improve mass transfer rate uniformity across the surface of the substrate. For example, the larger apertures 202 may reduce jet velocity and subsequently lower the strain rate/mass transfer rate, while a smaller pitch may help provide better averaging of the mass transfer rate. In areas proximate the center of the substrate, the crossflow effect is less pronounced, which may enable the use of smaller aperture pitches in this region.

Depending on the size of the plate 202 and the size of apertures 208, plate 202 may define any number of apertures 208 through plate 202, such as greater than or about 100 apertures, greater than or about 250 apertures, greater than or about 500 apertures, greater than or about 1,000 apertures, greater than or about 2,000 apertures, greater than or about 3,000 apertures, greater than or about 4,000 apertures, greater than or about 5,000 apertures, greater than or about 6,000 apertures, or more. As noted above, apertures 208 may be included in a set of rings extending outward from a central axis of plate 202 and may include any number of rings as described previously. The rings may be characterized by any number of shapes including circular or elliptical, as well as any other geometric pattern, such as rectangular, hexagonal, or any other geometric pattern that may include apertures distributed in a radially outward number of rings. The apertures may have a uniform or staggered spacing (i.e., pitch) and may be spaced apart at between or about 3 mm and 15 mm from center to center, between or about 4 mm and 12 mm, or between or about 5 mm and 10 mm, although other pitches are possible in various embodiments.

The rings may be characterized by any geometric shape as noted above, and in some embodiments, apertures may be characterized by a scaling function of apertures per ring. For example, in some embodiments a first aperture may extend through a center of plate 202, such as along the central axis as illustrated. A first ring of apertures may extend about the central aperture, and may include any number of apertures, such as between about 4 and about 10 apertures, which may be spaced equally about a geometric shape extending through a center of each aperture. Any number of additional rings of apertures may extend radially outward from the first ring and may include a number of apertures that may be a function of the number of apertures in the first ring. For example, the number of apertures in each successive ring may be characterized by a number of apertures within each corresponding ring according to the equation XR, where X is a base number of apertures, and R is the corresponding ring number. The base number of apertures may be the number of apertures within the first ring, and in some embodiments may be some other number, as will be described further below where the first ring has an augmented number of apertures. For example, for an exemplary plate having 5 apertures distributed about the first ring, and where 5 may be the base number of apertures, the second ring may be characterized by 10 apertures, (5)×(2), the third ring may be characterized by 15 apertures, (5)×(3), and the twentieth ring may be characterized by 100 apertures, (5)×(20). This may continue for any number of rings of apertures as noted previously, such as up to, greater than, or about 50 rings.

In some embodiments, one or more apertures 208 near a center of plate 202 may be different than the other apertures 208. For example, to avoid having one hole at a center of plate 202 (which may result in higher mass transfer rates at or near the center of the substrate, even with rotation of the substrate relative to spray jet array 200), the central most hole may be replaced by a number of smaller holes that are offset from a center of plate 202. To help maintain a consistent current density and strain rate across the substrate surface, the smaller holes may be sized to collectively deliver a same current rate and fluid flow rate as a single central aperture 208. In some embodiments, apertures 208 may each include a same diameter, while in other embodiments some or all of apertures 208 may have different diameters. For example, diameters proximate a center of plate 202 may be different sizes than apertures 208 further from the center of plate 202, which may enable the fluid conductance/flow rate to be varied across the substrate to help average the strain rate across the surface of the substrate.

Fluid may be delivered to second surface 206 such that the liquid electrolyte is forced through apertures 208. Due to the small size of apertures 208, the liquid electrolyte passing through apertures 208 forms pressurized jets extending from first surface 204 that may be directed upon a surface of a substrate positioned within a head, such as head 110. The pressurized jets may increase the strain rate of fluid against the substrate and may therefore increase the mass transfer rate of the plating operation.

To ensure that the plating rate is substantially uniform across the surface of the substrate it may be desirable to maintain the current density upon the substrate at a substantially uniform level across the surface of the substrate. In some embodiments, to ensure that the current density is uniform across a surface of the substrate, the positioning of plate 202 relative to the head of the electroplating system and positioning of apertures 208 on plate 202 may be designed such that a ratio of the gap between first surface 204 of plate 202 and the substrate and/or bottom surface of the head and a pitch between adjacent apertures 208 on plate 202 meets a certain threshold. For example, the ratio between the gap and the pitch may be at least about at least about 1:1, at least about 1.1:1, at least about 1.25:1, at least about 1.5:1, or greater. Such relationships may be maintained across all or a substantial portion (e.g., at least 75%, at least 80%, at least 85%, at least 90%, at least 95%, at least 97%, at least 99%, or more) of plate 202 and/or apertures 208.

In some embodiments, upon contacting the substrate, the pressurized jets of fluid may accumulate and scatter laterally outward from the surface of the substrate, creating a crossflow effect across at least a portion of the substrate surface, which may impact the mass transfer uniformity across the surface of the substrate as the crossflow may prevent the jets from impinging on the surface of the substrate in a uniform manner. To help reduce the effects of crossflow, a ratio between the pitch of apertures 208 on plate 202 to the diameter of apertures 208 on plate 202 may be at least 6:1, at least 6.5:1, at least 7:1, at least 7.5:1, at least 8:1, at least 8.5:1, at least 9:1, at least 9.5:1, at least 10:1, at least 11:1, at least 12:1, or greater. Such ratios may ensure that there is enough space between adjacent jets to prevent any crossflow from interfering with the impingement of a nearby jet. For example, the space between adjacent jets may provide clearance for laterally outward flowing fluid to pass to the edge of the substrate without interfering with the other jets. As will be discussed below in at least FIGS. 3A-5B, other techniques may be used to keep the current density substantially uniform across the surface of the substrate while reducing or minimizing the effects of crossflow.

While shown with first surface 204 and second surface 206 being planar, it will be appreciated that in some embodiments one or both of first surface 204 and second surface 206 may be nonplanar. For example, first surface 204 may include one or more higher and lower regions, which may place outlet ends of some of apertures 208 at different distances from the substrate. As just one example, a center portion of first surface 204 may be higher (or closer to the substrate) than an outer portion of first surface 204. Such adjustments may impact strain rates and mass transfer across the surface of the substrate by increasing the strain rate at some areas and/or decreasing the strain rate at other areas. Additionally, aperture pitch may be varied across plate 202 to control strain rate and/or electrical current uniformity across the surface of the substrate.

In some embodiments, each aperture 208 may be designed to produce turbulent jets of fluid. Turbulent flow may enhance mass transfer due to the flow dynamics, as well as due to enhanced turbulent diffusion. In some embodiments, the flow of fluid within each aperture 208 may be turbulent, along with the jets emanating from each aperture 208. In other embodiments, the jets may be turbulent even if flow within apertures 208 has not quite reached fully developed turbulent flow. Flow within apertures 208 may be considered turbulent the Reynolds number exceeds 2300. The Reynolds number depends upon the tube velocity and diameter as well as the fluid kinematic viscosity. For example, the Reynolds number may be equal to ($Re=V*D/v$). This Re criteria is for fully developed conditions in long apertures 208, however in some embodiments the jets emanating from apertures 208 that do not have Reynolds numbers exceeding 2300 may be turbulent. As noted above, aperture length may be a factor in generating fully developed turbulent flow within the aperture. As just one example, apertures 208 having diameters of 1 mm may have lengths of at least or about 16 mm to produce fully developed turbulent flow. A length of apertures 208 may be dictated by a thickness of plate 202 in the illustrated embodiment. In such embodiments, the transition to turbulence occurs over an entrance region of each aperture 208. It will be appreciated that other lengths may be possible depending on aperture diameter and fluid viscosity.

Figure 3A:
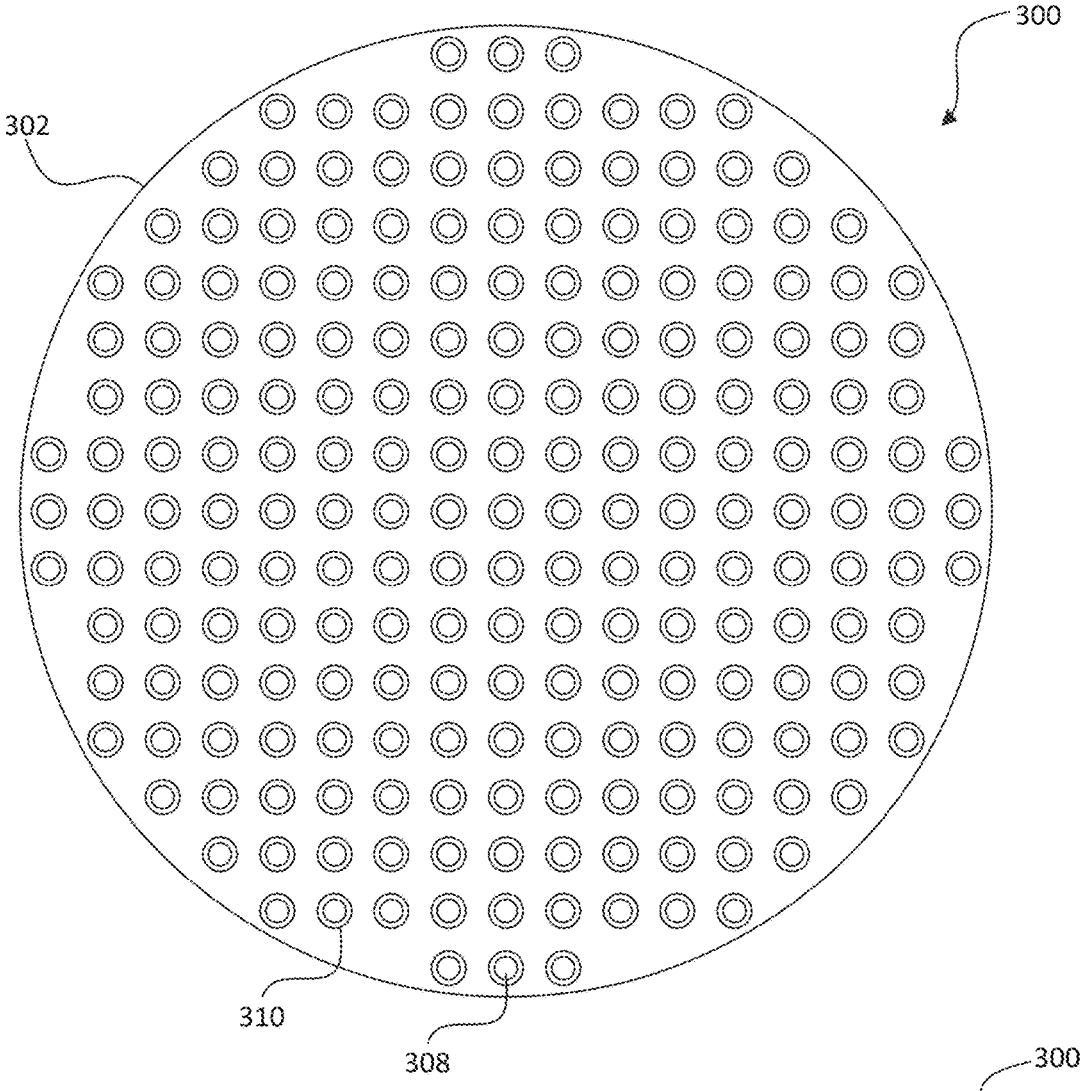
FIG. 3A shows a schematic top plan view of a spray jet array according to some embodiments of the present technology.
Figure 3B:
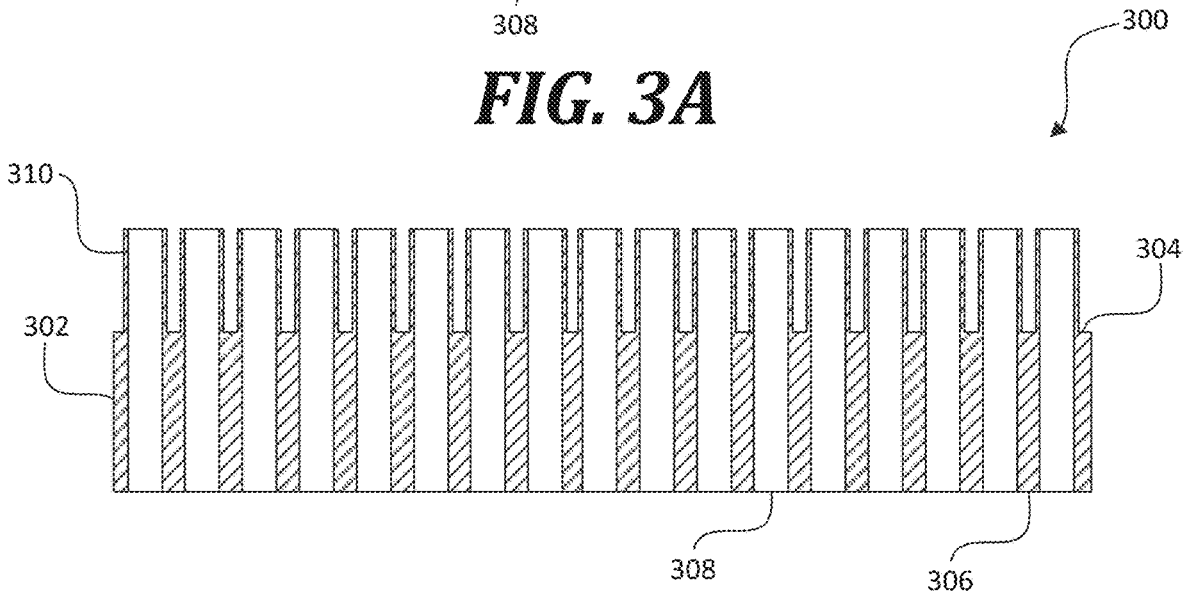
FIG. 3B shows a cross-sectional side elevation view of the spray jet array of FIG. 3A.

FIG. 3A shows a schematic top plan view of a spray jet array according to some embodiments of the present technology. FIG. 3B shows a cross-sectional side elevation view of the spray jet array of FIG. 3A. FIGS. 3A and 3B illustrate one embodiment of a spray jet array 300 according to some embodiments of the present technology. Spray jet array 300 may be used as a spray jet array within an electroplating system such electroplating system 100, as well as any chamber or system that may benefits from spray jet array 300. For example, spray jet array 300 may be used as spray jet array 125 and may be positioned within an interior of a plating vessel below a substrate-carrying head. Spray jet array 300 may be similar to spray jet array 200 and may include any feature described in relation to spray jet array 200. Spray jet array 300 may include a plate 302, which may be characterized by a first surface 304 (e.g., a top surface) and a second surface 306 (e.g., a bottom surface), which may be opposite first surface 304. Plate 302 may define a number of apertures 308 through plate 302 and extending from first surface 304 through second surface 306. Each aperture 308 may provide a fluid path through plate 302, with fluid passing through apertures 308 forming pressurized jets that may impinge on a substrate positioned within a head of an electroplating system.

Plate 302 may include a number of tubes 310 that extend upward from first surface 304 (e.g., a top surface) of plate 302. Tubes 310 may extend toward a bottom surface of the substrate and the head of the electroplating system. Each tube 310 may be aligned with and may partially define one of the apertures 308. In some embodiments, a number of tubes 310 matches a number of apertures 308 such that each aperture 308 extends through one of the tubes 310. This may position an outlet end of each aperture 308 at a distance from first surface 304 that matches a length or height of tube 310, which may provide additional space (e.g., gullies formed between tubes 310) for any crossflow to pass through without having a large impact on mass transfer rate uniformity. Each tube 310 may have a same or different height (e.g., protrusion distance from first surface 304). For example, each tube 310 may have a height of between or about 5 mm and 20 mm, between or about 7.5 mm and 15 mm, or between or about 10 mm and 12 mm. The additional clearance space created between adjacent apertures 308 through the presence of tubes 310 may enable smaller aperture pitches to be used without significantly impacting the effects of crossflow (e.g., non-uniform mass transfer rates). For example, pitches for apertures 308 may be between 2 mm and 12 mm from center to center, between 3 mm and 10 mm, or between 5 mm and 8 mm, although other pitches are possible in various embodiments. Smaller pitches may enable smaller gaps between the outlet ends of apertures 208 and the substate (e.g., based on the ratio of gap:pitch disclosed above). Smaller gaps may also enable better plating uniformity across the substrate.

To ensure that the plating rate is substantially uniform across the surface of the substrate it may be desirable to maintain the current density upon the substrate at substantially uniform levels across the surface of the substrate. In some embodiments, to ensure that the current density is uniform across a surface of the substrate, the positioning of plate 302 relative to the head of the electroplating system and positioning of apertures 308 on plate 302 may be designed such that a ratio of the gap between outlet ends of each aperture 308 (e.g., distal ends of tubes 310) and the substrate and/or bottom surface of the head and a pitch between adjacent apertures 308 on plate 302 meets a certain threshold. For example, the ratio between the gap and the pitch may be at least about 1:1, at least about 1.1:1, at least about 1.25:1, at least about 1.5:1, or greater. In some embodiments, spray jet array 300 may be positioned such that outlet ends of each aperture 308 are within 25 mm of a bottom surface of the substrate, within 20 mm of the substrate, within 15 mm of the substrate, within 10 mm of the substrate, within 8 mm of the substrate, within 7 mm or the substrate, within 6 mm of the substrate, within 5 mm of the substrate, or less. In some embodiments, a gap to diameter ratio may also be at least 6:1, at least 6.5:1, at least 7:1, at least 7.5:1, at least 8:1, at least 8.5:1, at least 9:1, at least 9.5:1, at least 10:1, at least 11:1, at least 12:1, or greater. To improve uniformity across the substrate, it may be desirable to use smaller gaps, which may lead the diameters of the apertures to be smaller (e.g., 1 mm or less). Smaller diameter apertures may generate higher jet velocities, which may lead to higher strain rates on the substrate surface. In some embodiments, high flow rates (such as at least 0.01 gpm, at least 0.02 gpm, at least 0.03 gpm, at least 0.04 gpm, at least 0.05 gpm, or more) per aperture may be used. Longer tubes may enable flow within the aperture/tube to become turbulent, which may enhance strain rates on the substrate. In some embodiments, plate 302 may be thinner than plate 202 while producing turbulent flow, as tubes 310 may add length to each aperture 308 that extends beyond a thickness of plate 302.

Figure 4A:
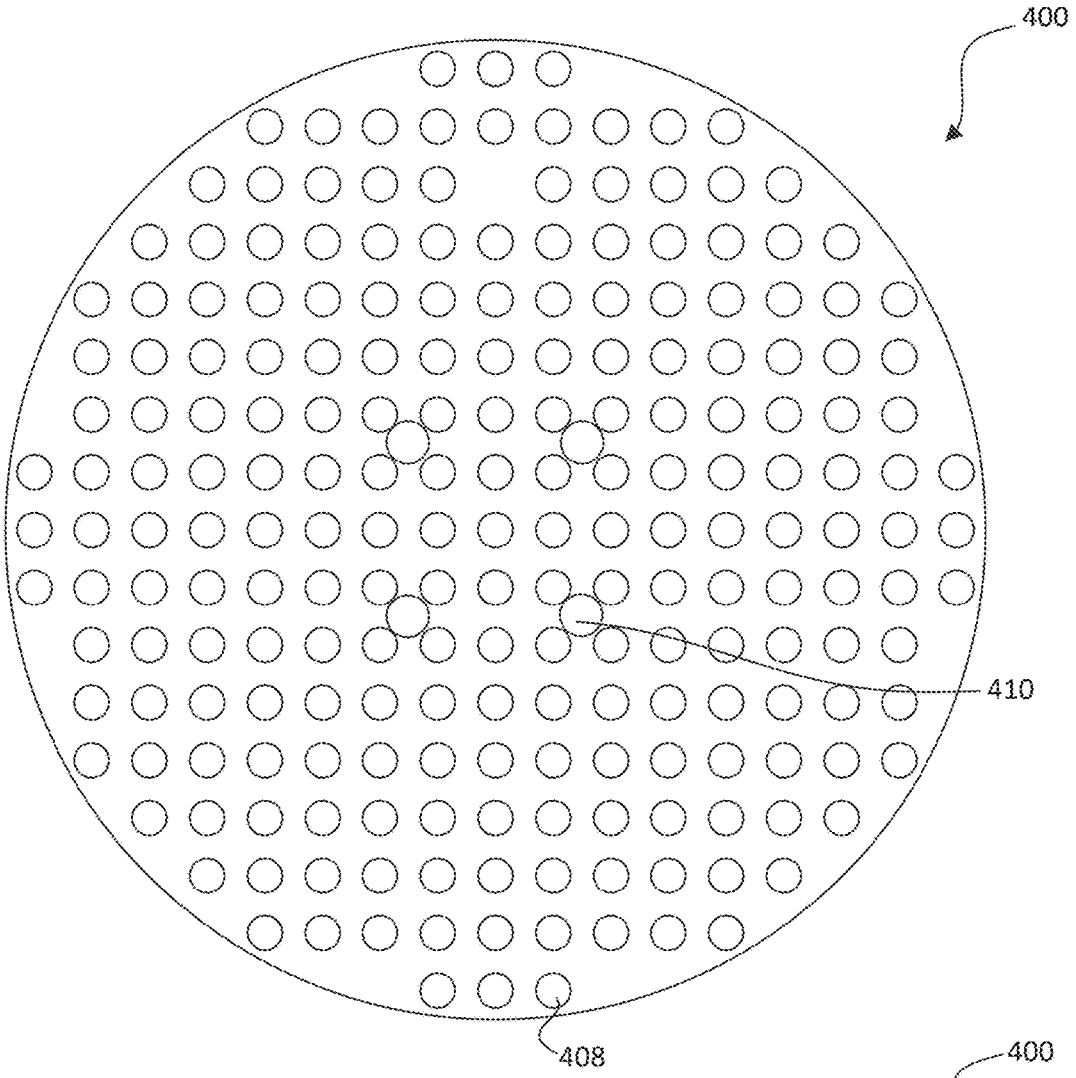
FIG. 4A shows a schematic top plan view of a spray jet array according to some embodiments of the present technology.
Figure 4B:
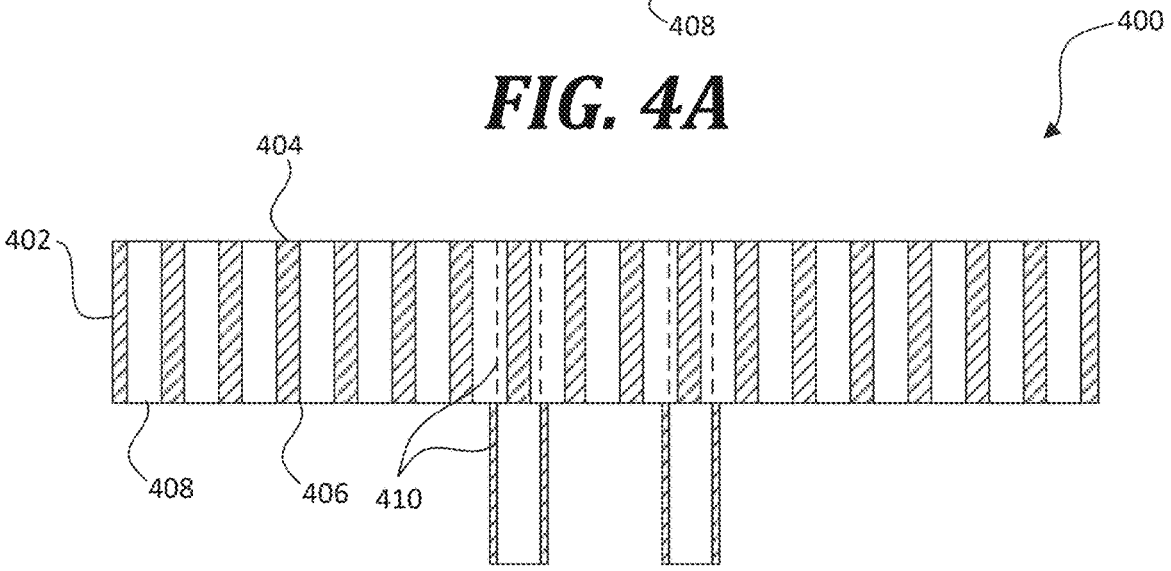
FIG. 4B shows a cross-sectional side elevation view of the spray jet array of FIG. 4A.

FIG. 4A shows a schematic top plan view of a spray jet array according to some embodiments of the present technology. FIG. 4B shows a cross-sectional side elevation view of the spray jet array of FIG. 4A. FIGS. 4A and 4B illustrate one embodiment of a spray jet array 400 according to some embodiments of the present technology. Spray jet array 400 may be used as a spray jet array within an electroplating system such electroplating system 100, as well as any chamber or system that may benefit from spray jet array 400. For example, spray jet array 400 may be used as spray jet array 125 and may be positioned within an interior of a plating vessel below a substrate-carrying head. Spray jet array 400 may be similar to spray jet array 200 and spray jet array 300 and may include any feature described in relation to spray jet array 200 or spray jet array 300. Spray jet array 400 may include a plate 402, which may be characterized by a first surface 404 (e.g., a top surface) and a second surface 406 (e.g., a bottom surface), which may be opposite first surface 404. Plate 402 may define a number of apertures 408 through plate 402 and extending from first surface 404 through second surface 406. Each aperture 408 may provide a fluid path through plate 402, with fluid passing through apertures 408 to form pressurized jets that may impinge on a substrate positioned within a head of an electroplating system.

To help reduce the effects of crossflow, plate 402 may define a number of drain tubes 410 through a thickness of plate 402. In some embodiments, bottom ends of drain tubes 410 may extend beyond second surface 406, such as by a distance that extends beyond a fluid supply source that pumps the fluid to inlet ends of apertures 408. Such positioning May ensure that fluid is not pumped upward through drain tubes 410. Drain tubes 410 may be positioned about plate 402 to enable a portion of the fluid to be drained from the gap between plate 402 and the substrate. For example, rather than being coupled with a fluid pump and delivering jets of fluid to the substrate like apertures 408, drain tubes 410 may collect and drain fluid that is circulating above plate 402. This drainage may help reduce the effects of crossflow on mass transfer uniformity. Drain tubes 410 may be positioned between some or all apertures 408. In some embodiments, drain tubes 410 may be distributed across an entire surface of plate 402, such as between each ring or row of apertures 408. In other embodiments, drain tubes 410 may be positioned at particular radial locations about plate 402. As just one example, drain holes 410 may be positioned at radial positions that are close to a center of plate 402 and/or within a medial region of plate 402. For example, drain holes 410 may be positioned within an inner 60%, inner 50%, inner 40%, inner 30%, inner 20%, inner 10%, inner 5%, or less of plate 402, although drain holes 410 may be positioned at any radial position in various embodiments. Drain holes 410 may be positioned at regular angular and/or radial intervals about plate 402. Drain holes 410 may have a same or different (e.g., smaller or larger) diameter than apertures 408. For example, in some embodiments each drain hole 410 may have a greater diameter than each aperture 408, which may enable fewer drain holes 410 to be used. In some embodiments, each drain hole 410 may have a diameter of between or about 1 mm and 10 mm, between or about 2 mm and 8 mm, or between or about 4 mm and 6 mm.

Figure 5A:
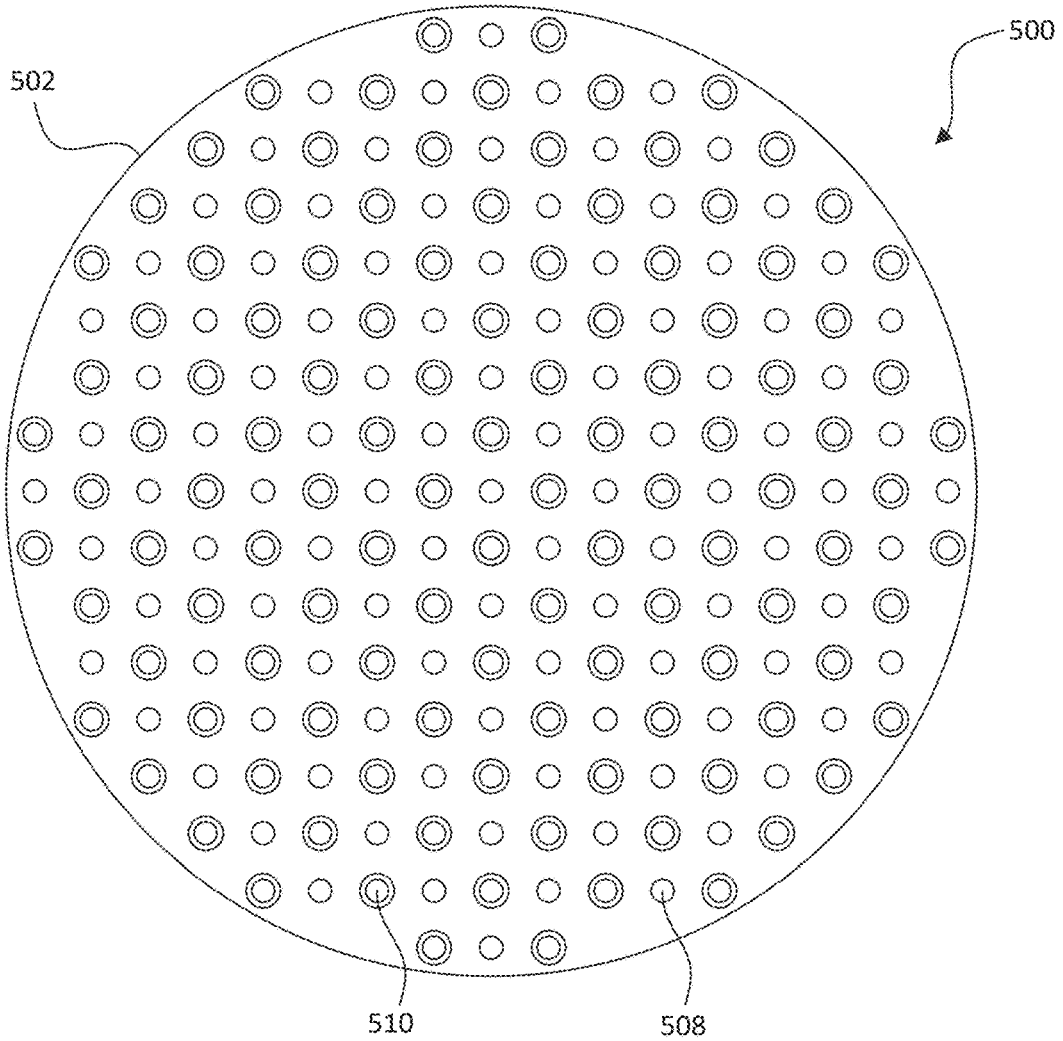
FIG. 5A shows a schematic top plan view of a spray jet array according to some embodiments of the present technology.
Figure 5B:
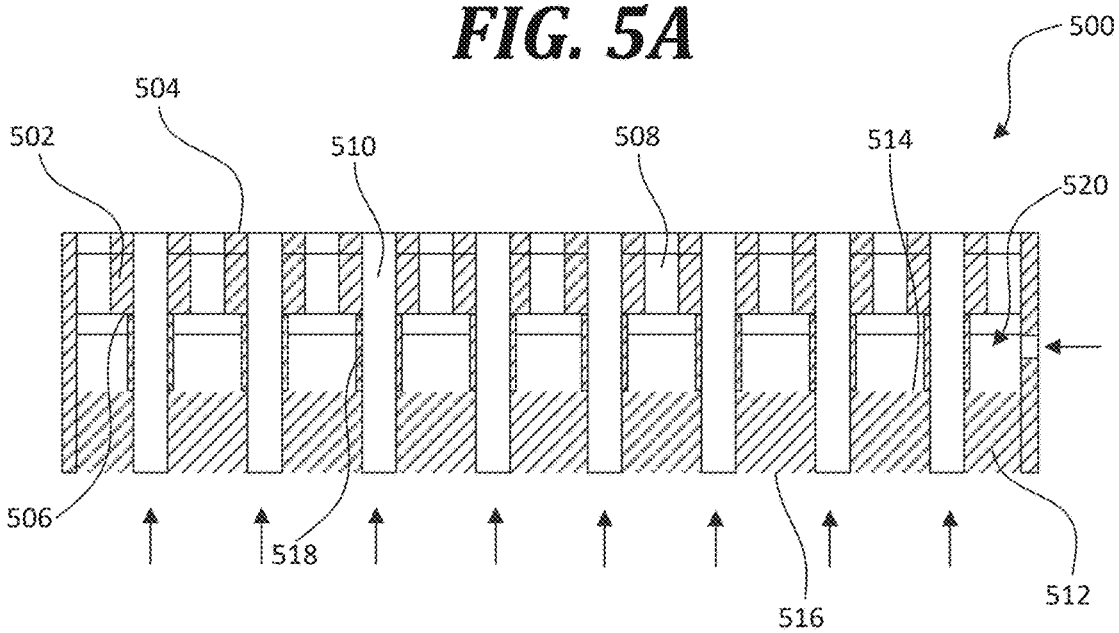
FIG. 5B shows a cross-sectional side elevation view of the spray jet array of FIG. 5A.

FIG. 5A shows a schematic top plan view of a spray jet array according to some embodiments of the present technology. FIG. 5B shows a cross-sectional side elevation view of the spray jet array of FIG. 5A. FIGS. 5A and 5B illustrate one embodiment of a spray jet array 500 according to some embodiments of the present technology. Spray jet array 500 may be used as a spray jet array within an electroplating system such electroplating system 100, as well as any chamber or system that may benefit from spray jet array 500. For example, spray jet array 500 may be used as spray jet array 125 and may be positioned within an interior of a plating vessel below a substrate-carrying head. Spray jet array 500 may be similar to spray jet array 200, spray jet array 300, and spray jet array 400 and may include any feature described in relation to spray jet array 200, spray jet array 300, or spray jet array 400. Spray jet array 500 may be a dual-channel array and may include a first plate 502, which may be characterized by a first surface 504 (e.g., a top surface) and a second surface 506 (e.g., a bottom surface), which may be opposite first surface 504. First plate 502 may be a top plate of spray jet array 500 and may define a number of first apertures 508 through first plate 502 and extending from first surface 504 through second surface 506. Each first aperture 508 may provide a fluid path through first plate 502, with fluid through first apertures 508 to form pressurized jets that may impinge on a substrate positioned within a head of an electroplating system.

First plate 502 may define a number of second apertures 510 through first plate 502. First apertures 508 and second apertures 510 may form two different flow paths through first plate 502. Second apertures 510 may be positioned in between some or all of first apertures 508. For example, first apertures 508 and second apertures 510 may be arranged in an alternating fashion, with a second aperture 510 positioned within each gap between adjacent first apertures 508 in one or two rows/rings of first apertures 508. In some embodiments, first apertures 508 and second apertures 510 may be arranged in a same row/ring, with a second aperture 510 being positioned between each pair of adjacent first apertures 508. In some such embodiments, adjacent rows/rings apertures may be aligned such that along a given radial line, each row/ring includes only first apertures 508 or second apertures 510. In other such embodiments, adjacent rows/rings apertures may be aligned such that along a given radial line, each row/ring alternates between first apertures 508 and second apertures 510. In some embodiments, first apertures 508 and second apertures 510 may be arranged in different alternating rows/rings, with a row/ring of second apertures 510 being positioned between each pair of adjacent rows/rings first apertures 508. In some such embodiments, apertures in each row may be aligned along the same radial lines. In other such embodiments, adjacent rows/rings apertures may be aligned such that a second aperture 510 is disposed between four adjacent first apertures 508 (e.g., two first apertures 508 from one row/ring and two additional first apertures 508 from an adjacent row/ring). It will be appreciated that the arrangements described above are merely provided as examples and that other arrangements are possible. For example, first apertures 508 and second apertures 510 may be arranged in non-alternating fashions. Arrangements of first apertures 508 and/or second apertures 510 may be generally uniform and/or symmetric in some embodiments, while in other embodiments arrangements of first apertures 508 and/or second apertures 510 may be non-uniform and/or asymmetric.

In some embodiments, a number of first apertures 508 may match or substantially match (e.g., within 10%, within 5%, within 3%, within 1%, etc.) a number of second apertures 510. In other embodiments, a number of first apertures 508 may be substantially different (e.g., over 10%) than a number of second apertures 510. First apertures 508 and second apertures 510 may have the same or different diameters. Similarly, first apertures 508 may collectively have a same or substantially same (e.g., within 10%, within 5%, within 3%, within 1%, etc.) flow conductance and/or current conductance as second apertures 510, collectively.

Spray jet array 500 may include a second plate 512, which may be characterized by a first surface 514 (e.g., a top surface) and a second surface 516 (e.g., a bottom surface), which may be opposite first surface 514. In some embodiments, a peripheral wall may couple first plate 502 and second plate 512. Second plate 512 may be a bottom plate of spray jet array 500 and may define a portion of each second aperture 510 through second plate 512. Second plate 512 may be coupled with first plate 502, such as on a bottom side of first plate 502. A number of tubes 518 may extend between first plate 502 and second plate 512. Each lumen 518 may be aligned with and may partially define one of second apertures 510. A number of tubes 518 may match a number of second apertures 510 such that each second aperture 510 is defined by a respective lumen 518. In embodiments with two plates, an inlet end of each first aperture 508 may be formed through second surface 506 of first plate 502. An inlet end of each second aperture 510 may be formed through second surface 516 of second plate 512. An outlet end of each first aperture 508 and each second aperture 510 may be formed through first surface 504 of first plate 502.

A plenum 520 may be defined between first plate 502 and second plate 512, such as forming a portion of a volume between first plate 502 and second plate 512 that extends about an exterior of each lumen 518. Plenum 520 may form a portion of a flow path for pumping fluid through first apertures 508. For example, as shown in FIG. 5A, fluid may be introduced into plenum 520, such as through a lateral side of the peripheral wall coupling the plates and/or through a separate aperture defined through second plate 512. The fluid may fill plenum 520 and be forced through the inlets of first apertures 508 to form pressurized jets that are emitted from the outlets of first apertures 508. Similarly, fluid may be introduced to second surface 516 of second plate 512 and be forced through the inlets of second apertures 510 to form pressurized jets that are emitted from the outlets of second apertures 510. The fluid pumps of an electroplating system, such as fluid pump 140, may control a flow of fluid to first apertures 508 and second apertures 510 independently, such that fluid may be flowed through one or both sets of apertures at any given time. Similarly, a power source, such as power source 145, may control a flow of current to first apertures 508 and second apertures 510 independently, such that a same or different current may be flowed through one or both sets of apertures at any given time.

The use of dual-channel spray jet array 500 may enable gaps between outlets of each aperture and the substrate to be smaller while also keeping a pitch between adjacent apertures small, which may result in improved strain rate uniformity and current density uniformity across a surface of the substrate. For example, flow of fluid through first apertures 508 and second apertures 510 may be cycled such that fluid flows through only a single set of apertures at a given time. In embodiments in which first apertures 508 and second apertures 510 are arranged about first plate 502 in an alternating fashion, such cycling may increase the effective pitch at a given instant as only half of the apertures on first plate 502 are delivering jets of fluid at that time. The increased pitch reduces the impact of crossflow on the strain rate uniformity. At a later point, the other half of the apertures on first plate 502 may deliver jets of fluid, which maintains a greater aperture pitch. The cycling ensures that at some point during the plating process, apertures proximate each radial location of the substrate are delivering jets of fluid. Current may be supplied to the substrate via the fluid, including the pressurized jets of fluid.

By cycling delivery of fluid to the different fluid channels (e.g., first apertures 508 and second apertures 510), spray jet array 500 may collectively provide an aperture pitch that may facilitate uniform strain rates across the substrate, while also being sufficiently large to prevent and/or mitigate crossflow effects. As just one example, first apertures 508 and second apertures 510 may be arranged in an alternating fashion about plate 502, such as with a pitch between adjacent first and second apertures being 5 mm (or some other small pitch). This pitch value enables the use of a gap on the order of 5 mm. However, a pitch between two adjacent first apertures 508 may be larger, such as 10 mm (or other first aperture pitch). Similarly, a pitch between two adjacent second apertures 510 may be larger, such as 10 mm (or other second aperture pitch). Thus, when only one set of apertures (e.g., first apertures 508) delivers fluid to the substrate, spray jet array 500 effectively operates with the larger 10 mm pitch. When the fluid is cycled to be delivered via the other set of apertures (e.g., second apertures 510), spray jet spray jet array 500 effectively operates with the larger 10 mm pitch. The larger flow pitch of 10 mm avoids cross flow effects that would be seen with the smaller 5 mm pitch. Collectively, however, the pitch is the smaller 5 mm pitch, as both sets of apertures have been used to deliver the fluid for some period of time (which may be the same or different). Any number of such cycles may be utilized in various plating operations. Additionally, due to the larger pitch at any given instant, a gap between first plate 502 and the substrate/carrier head may be reduced while still maintaining the ratios that promote uniform current density and strain rates across a surface of the wafer. For example, the gap between first plate 502 and the substrate/carrier head may be less than 10 mm, less than 9 mm, less than 8 mm, less 7 mm, less than 6 mm, less than 5 mm, or less.

It will be appreciated that spray jet arrays 200, 300, 400, and 500 are merely provided as examples and that numerous variations may exist. Additionally, various combinations of features from the example spray jet array (or other spray jet arrays) may be utilized in accordance with the present invention.

Figure 6A:
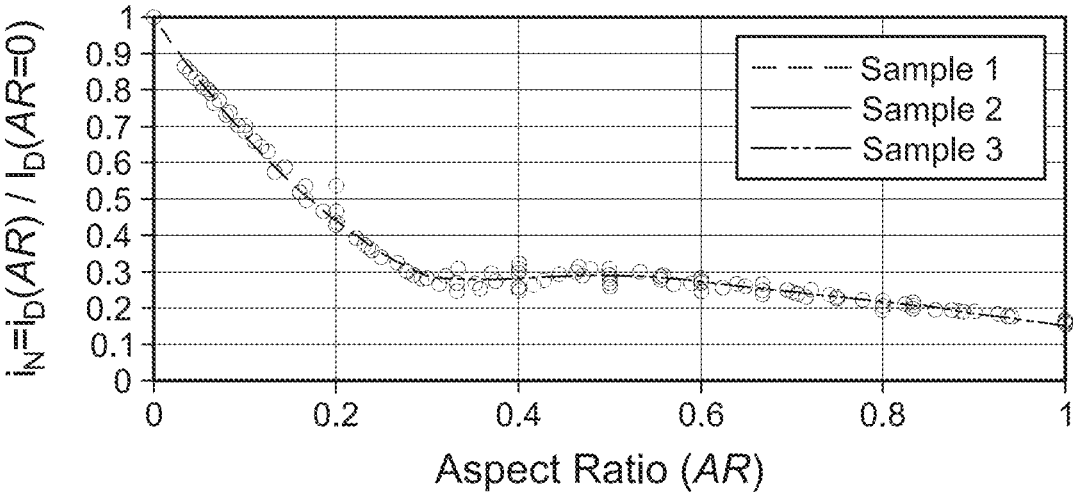
FIGS. 6A-6B are graphs of via mass-transfer models used to estimate limiting currents, according to some embodiments of the present technology.
Figure 6B:
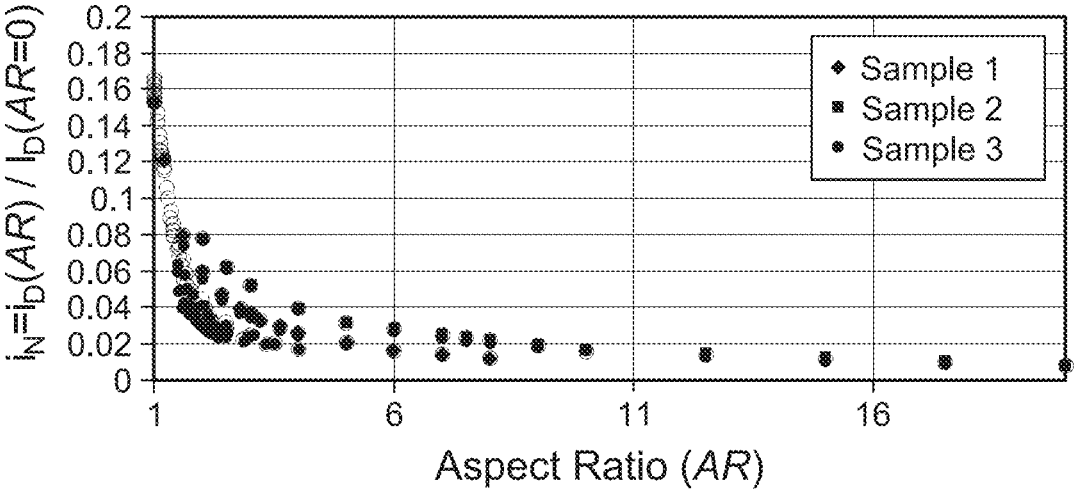

FIGS. 6A-6B are graphs of via mass-transfer models used to estimate limiting currents, according to some embodiments of the present technology. On the vertical axis is the current ratio $(i_N=i_D)(AR)/I_D(AR=0)$. On the horizontal axes is the aspect ratio (AR) of the Cu feature that is being deposited (diameter/depth). The graphs in FIGS. 6A and 6B illustrate same phenomenon, just on different scales. For Example, the graph of FIG. 6A shows currents for the aspect ratios (AR) ranging from 0 to 1, whereas the graph of FIG. 6B shows currents for the ARs ranging from 1 to less than 16. As used herein, $I_N$ is normalized current ratio, $I_D$ is diffusion limited current at AR=AR, and $I_D(AR=0)$ is diffusion limited current for a flush via (i.e., one with no depth).

As shown in FIGS. 6A-6B, as the aspect ratio increases, the limiting current decreases exponentially. As used herein, limiting current means the partial current due to Cu deposition cannot be increased further because the Cu++ ions at the surface are all being consumed and the Cu concentration at the surface is near zero. Furthermore, with an increase in AR, the limiting current generally asymptotes. For example, for any AR larger than about 6 the limiting current becomes less than about 0.03 A.

Figure 7:
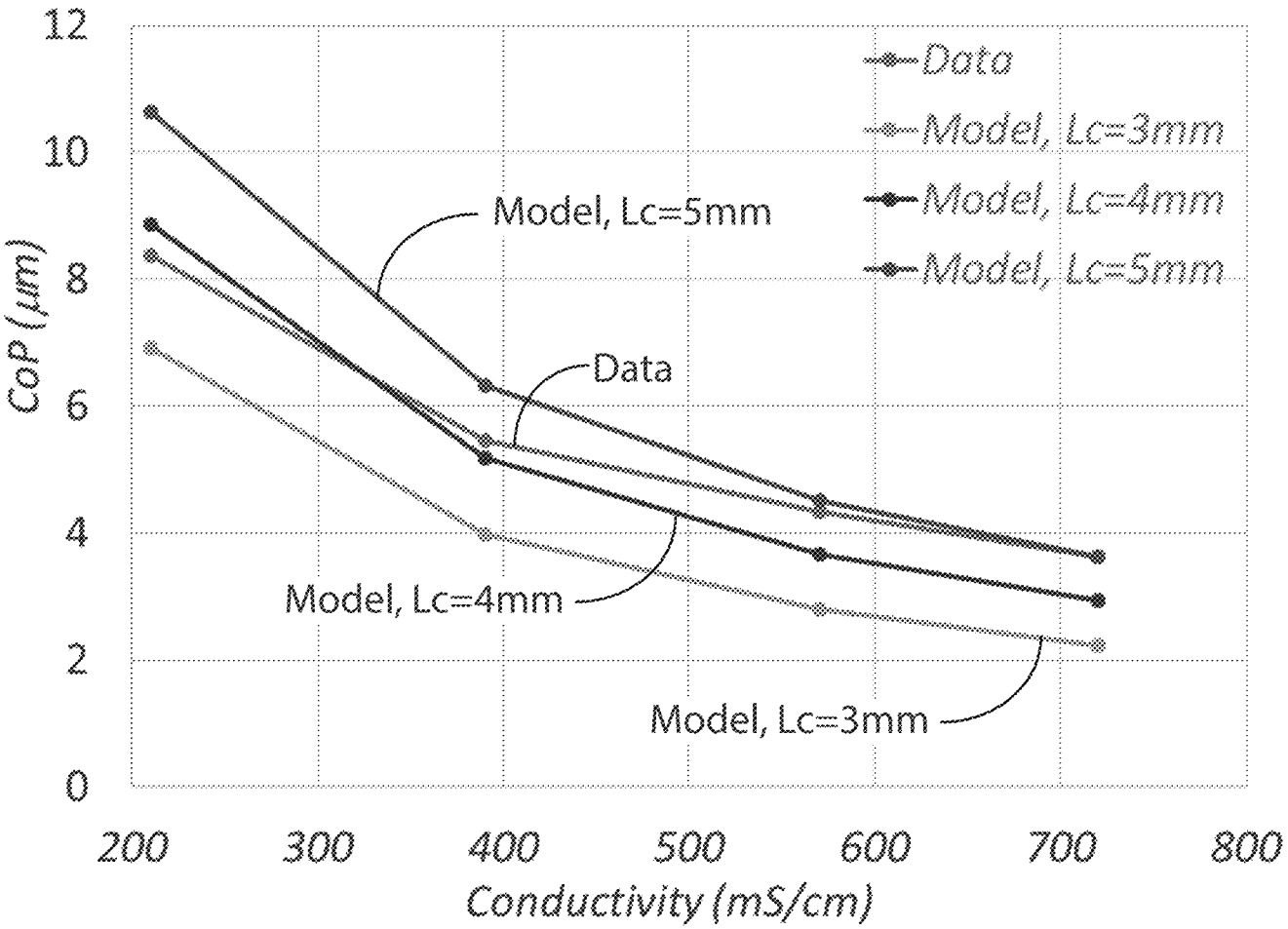
FIG. 7 is a graph of coplanarity as conductivity of a Cu bath is increased, according to some embodiments of the present technology.

FIG. 7 is a graph of coplanarity as conductivity of a Cu bath is increased, according to some embodiments of the present technology. On the vertical axis is the coplanarity (CoP) in μm of the upper surface of the test Cu structures. On the horizontal axis is the conductivity in mS/cm. Different lines represent modeled values for different Lc's. As used herein, Lc is characteristic length (Sample 1, Sample, 2, Sample 3). It could be a characteristic dimension of a die. For example a die width or length. Alternatively, it could be the distance between vias that have the highest and lowest deposition rates, respectively.

Shown in FIG. 7 is the results of an experiment ("Data") with an AXPIC having and array of 75×50 μm pillars, a photoresist thickness of 50 μm, an open area of 12%, a dense region of 18.75% open, a sparse region of 3.125% open, and a die size of 15 mm. The rate of deposition of Cu was 1 μm/min, the target deposition of Cu was 40 μm, and D at 35° C. was $7.62e^{10}$-10 $m^2$/sec. The Cu2+ concentration was 30 g/L or 0.472M, the temperature (T) was 300K, $\alpha_c$ is 0.517, and $j_O$ is 0.5 mA/$cm^2$.

This data is compared with three models having Lc of 3 mm, 4 mm, and 5 mm, respectively. As shown in FIG. 7, as the conductivity increased the coplanarity decreased. As explained above, a conductivity increase requires a higher acid concentration, which, in turn, requires a lower Cu concentration.

Figure 8A:
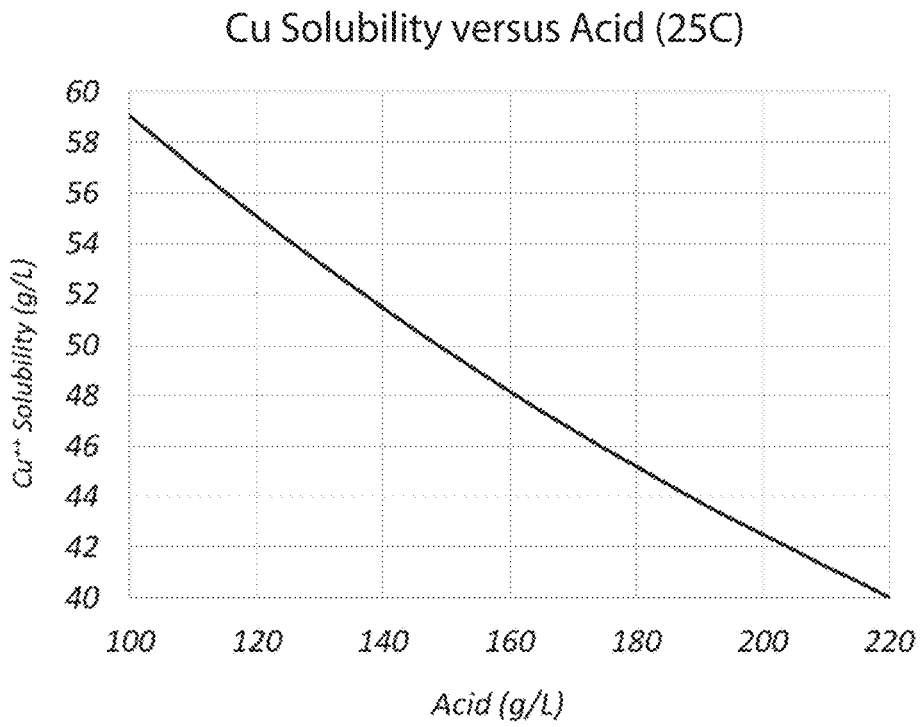
FIG. 8A is a graph of Cu solubility of a Cu bath as acid concentration of the Cu bath is increased, according to some embodiments of the present technology.

FIG. 8A is a graph of Cu solubility of a Cu bath as acid concentration of the Cu bath is increased, according to some embodiments of the present technology. On the vertical axis is $Cu^{2+}$ solubility in g/L. On the horizontal axis is acid concentration in g/L. As explained above, as the acid concentration increases, the $Cu^{2+}$ solubility in the Cu bath decreases.

Figure 8B:
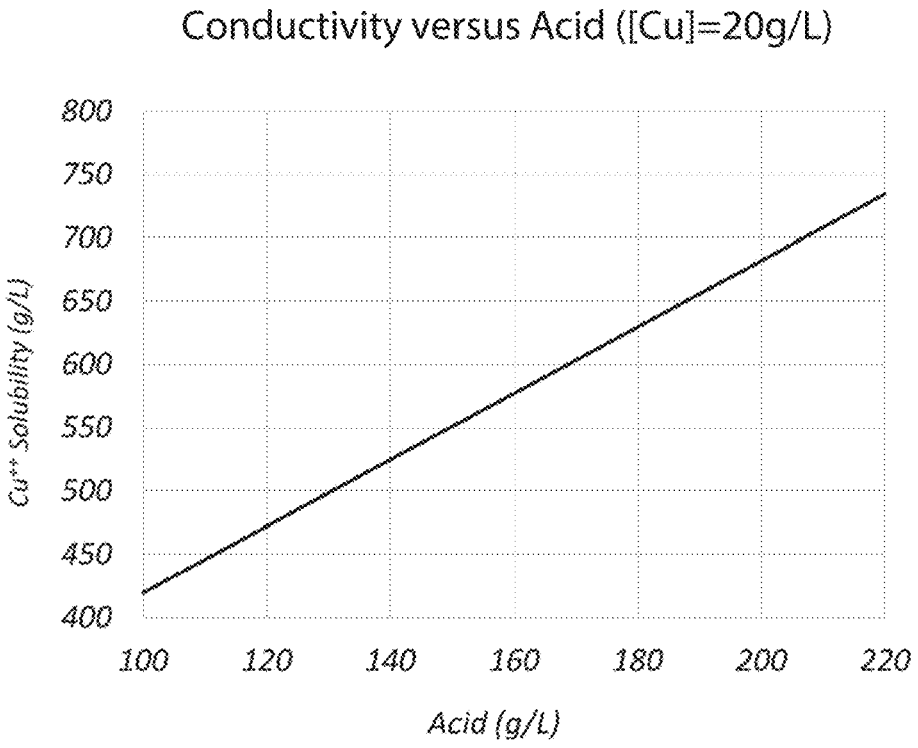
FIG. 8B is a graph of Cu solubility of a Cu bath as acid concentration of the Cu bath is increased, according to some embodiments of the present technology.

FIG. 8B is a graph of Cu conductivity of a Cu bath as acid concentration of the Cu bath is increased, according to some embodiments of the present technology. On the vertical axis is $Cu^{2+}$ solubility in g/L. On the horizontal axis is acid concentration in g/L. As explained above, as the acid concentration increases, the conductivity of the Cu bath increases. While the increased conductivity caused by the increased acid concentration is desirable from the Cu deposition point of view, the decreased Cu solubility limits the amount of Cu ions in the Cu bath, thus limiting the rate of Cu deposition. The interplay of these factors and the beneficial effect of spraying the jets over the wafer is further discussed with respect to FIG. 9 below.

Figure 9:
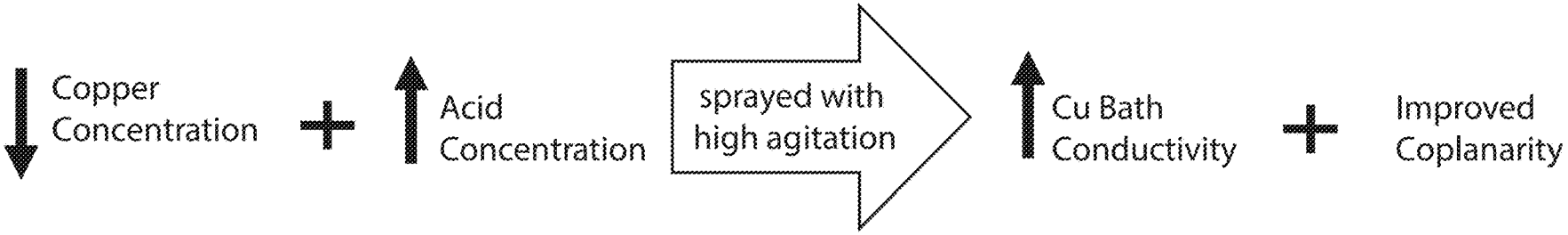
FIG. 9 is a visual representation of the properties and effects of spraying fluid with a jet array, according to some embodiments of the present technology.

FIG. 9 is a visual representation of the properties and effects of spraying fluid with a jet array, according to some embodiments of the present technology. When the Cu bath has a lower Cu concentration (such as 60 g/L to 40 g/L) and a higher acid concentration (such as 100 g/L to 220 g/L) and the Cu bath is sprayed as a fluid with high agitation (such as with a strain rate of 5,000 to about 30,000 per second), advantageously the Cu bath conductivity increases, which improves coplanarity of the deposited Cu. Stated differently, the high agitation of the Cu bath fluid that is generated by the jet array may overcome the limits imposed by the lower Cu concentration in the Cu bath fluid.

Figure 10:
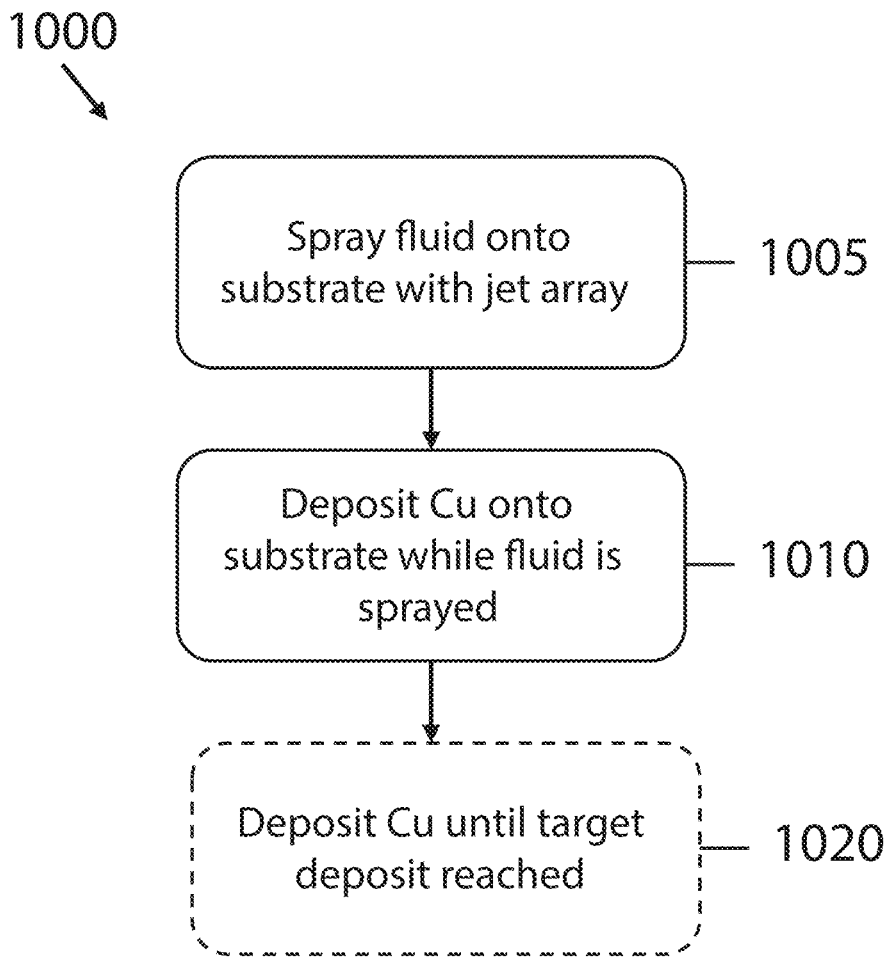
FIG. 10 is an example method of improving coplanarity of a semiconductor device, according to some embodiments of the present technology.

FIG. 10 is an example method 1000 of improving coplanarity of a semiconductor device, according to some embodiments of the present technology. In some embodiments, the method 1000 is performed by an electroplating system (such as electroplating system 100) having a jet array (such as jet array 125) and a Cu bath, where the Cu bath is characterized by a predetermined threshold of Cu concentration, and a predetermined threshold of acid concentration, as explained in FIG. 9. In some embodiments, the jet array is configured to spray a fluid, where the fluid has a same composition as the Cu bath.

In block 1005, the jet array sprays the fluid onto a substrate. In some embodiments, spraying the substrate increases a deposition rate of a deposited Cu onto the substrate. In some embodiments, the deposition rate is about 0.5 μm/min to about 3 μm/min. In some embodiments, the predetermined threshold of Cu concentration is between about 10 grams/Liter to about 50 grams/Liter. In some embodiments, the jet array sprays the fluid at the wafer creates wafer surface strain rates of about 5,000 to about 30,000 per second.

In block 1010, Cu is deposited onto the substrate while the jet array is spraying the fluid. In some embodiments, the predetermined threshold of acid concentration increases a bath conductivity of the Cu bath, and the increased bath conductivity improves a coplanarity of the semiconductor device. In some embodiments, the Cu bath conductivity is between about 400 mS/cm and about 800 mS/cm.

In block 1020, optionally, Cu is deposited until a target deposit is reached. In some embodiments, the target deposit is between about 10 μm and about 100 μm. In some embodiments, the target deposit is 40 μm. In some embodiments, the deposited Cu has an aspect ratio of about 0.4 to about 20.

Figure 11:
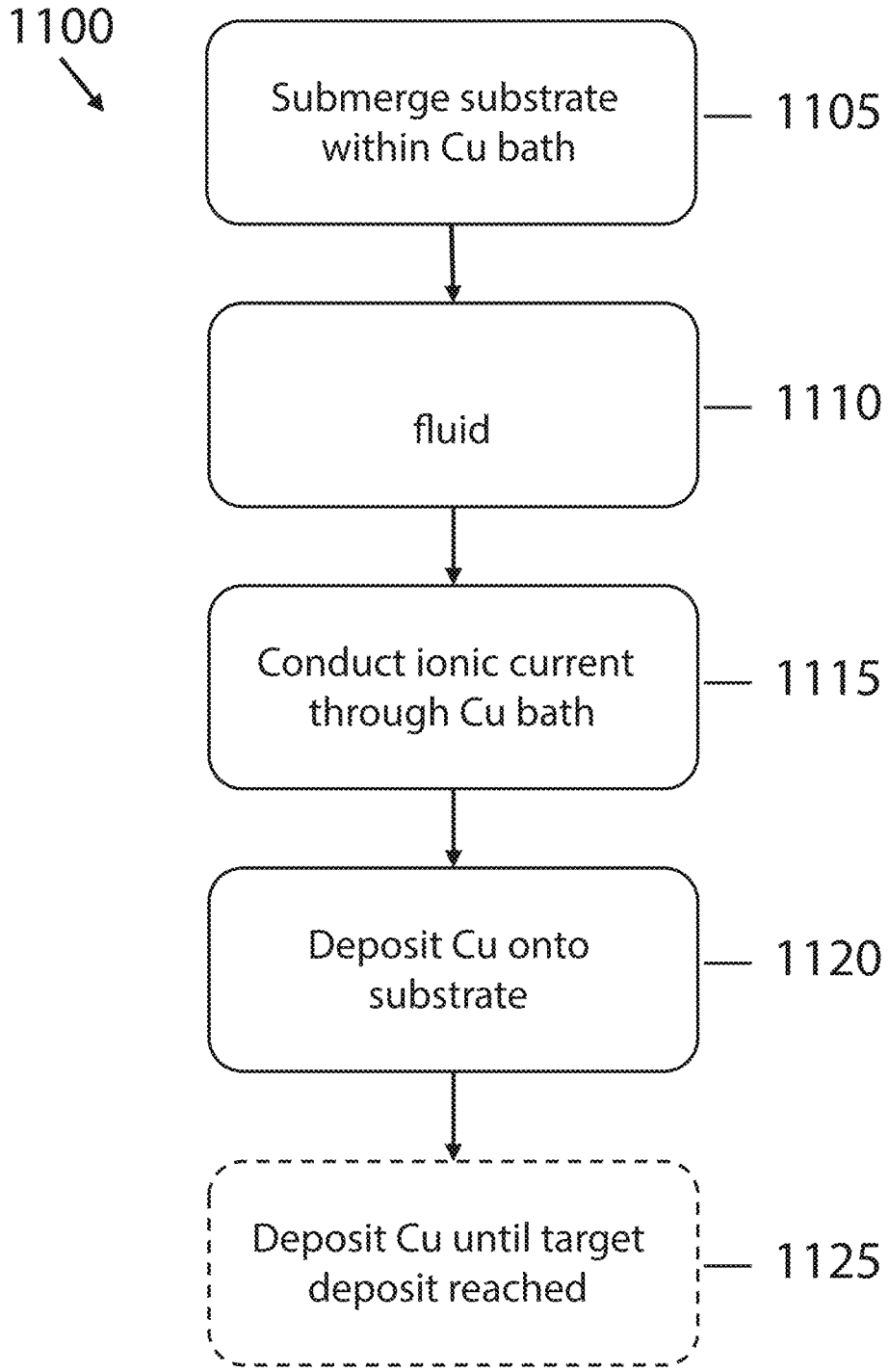
FIG. 11 is another example method of improving coplanarity of a semiconductor device, according to some embodiments of the present technology.

FIG. 11 is another example method 1100 of improving coplanarity of a semiconductor device, according to some embodiments of the present technology. In some embodiments, the method 1100 is performed by an electroplating system (such as electroplating system 100) having a jet array (such as jet array 125) and a Cu bath, where the Cu bath is characterized by a predetermined threshold of Cu concentration, and a predetermined threshold of acid concentration, as explained in FIG. 9. In some embodiments, the jet array is configured to spray a fluid, where the fluid has a same composition as the Cu bath. In some embodiments, the electroplating system further includes a head (such as head 110) that is configured to hold a substrate.

The substrate may be placed onto the head before the method 1100 begins.

In block 1105, the substrate is submerged in the Cu bath.

In block 1110, the jet array sprays the fluid onto a substrate. In some embodiments, spraying the substrate increases a deposition rate of a deposited Cu onto the substrate. In some embodiments, the deposition rate is about 0.5 μm/min to about 3 μm/min. In some embodiments, the predetermined threshold of Cu concentration is between about 10 grams/Liter to about 50 grams/Liter. In some embodiments, the jet array sprays the fluid at a strain rate of about 20,000 to about 30,000 per second.

In block 1115, ionic current is conducted through the Cu bath (and the fluid).

In block 1120, Cu is deposited onto the substrate while the jet array is spraying the fluid. In some embodiments, the predetermined threshold of acid concentration increases a bath conductivity of the Cu bath, and the increased bath conductivity improves a coplanarity of the semiconductor device. In some embodiments, the Cu bath conductivity is between about 400 mS/cm and about 800 mS/cm.

In block 1125, optionally, Cu is deposited until a target deposit is reached. In some embodiments, the target deposit is between about 10 μm and about 100 μm. In some embodiments, the target deposit is 40 μm. In some embodiments, the deposited Cu has an aspect ratio of about 0.4 to about 20.

Figure 12:
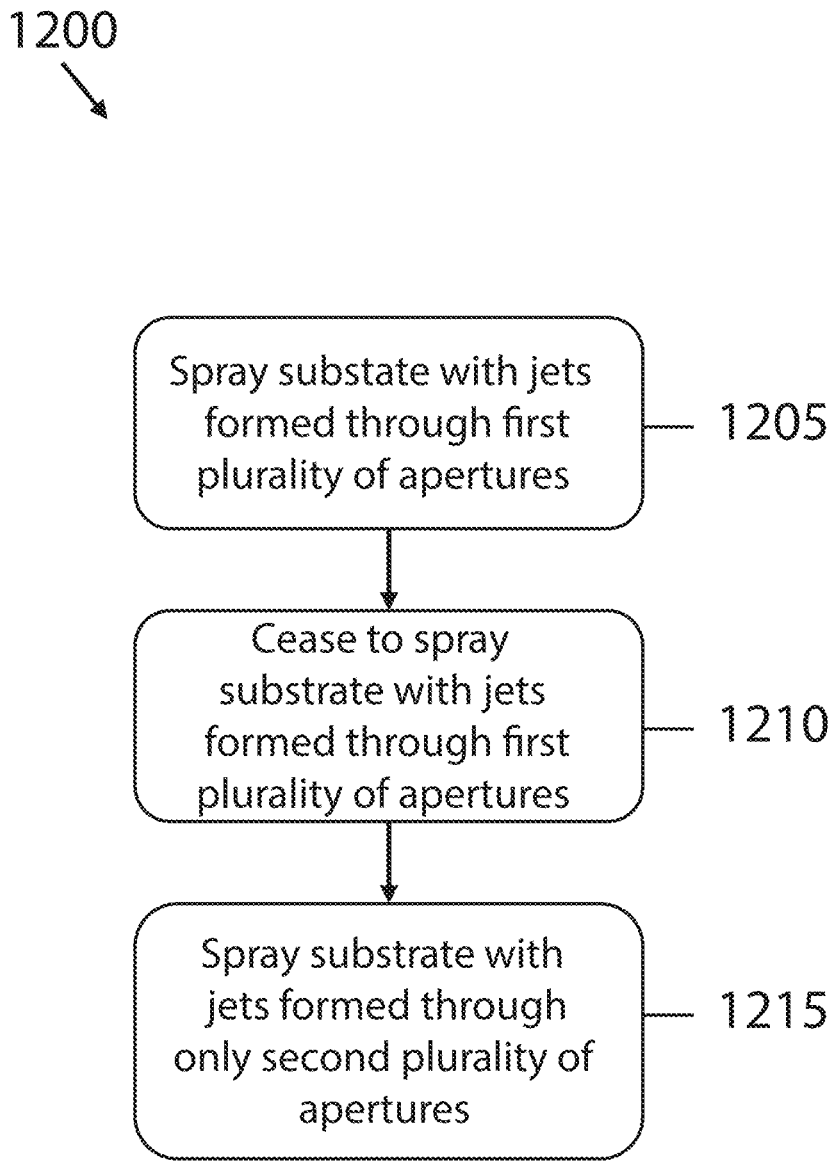
FIG. 12 is yet another example method of improving coplanarity of a semiconductor device, according to some embodiments of the present technology.

FIG. 12 is yet another example method 1200 of improving coplanarity of a semiconductor device, according to some embodiments of the present technology. In some embodiments, the method 1200 is performed by an electroplating system (such as electroplating system 100) having a jet array (such as jet array 125) and a Cu bath, where the Cu bath is characterized by a predetermined threshold of Cu concentration, and a predetermined threshold of acid concentration, as explained in FIG. 9. In some embodiments, the jet array is configured to spray a fluid, where the fluid has a same composition as the Cu bath. In some embodiments, the jet array further includes a plurality of apertures (such as apertures 208, 308, 408, 508) disposed on a plate (such as plate 208, 308, 408, 508). In some embodiments, the plate is a first plate (such as first plate 502) and the plurality of apertures is a first plurality of apertures (such as first plurality of apertures 508), and the jet array further includes a second plate (such as second plate 512) coupled with the first plate on a bottom side of the first plate, and a second plurality of apertures (such as second plurality of apertures 510), where an outlet end of each of the first plurality of apertures and each of the second plurality of apertures extends through a top surface of the first plate, an inlet end of each of the first plurality of apertures extends through a bottom surface of the first plate, and an inlet end of each of the second plurality of apertures extends through a bottom surface of the second plate (as illustrated and described in FIGS. 5A-5B).

In block 1205, the substrate is sprayed with jets formed through only the first plurality of apertures. In some embodiments, the jet array sprays the fluid onto a substrate. In some embodiments, spraying the substrate increases a deposition rate of a deposited Cu onto the substrate. In some embodiments, the deposition rate is about 0.5 μm/min to about 3 μm/min. In some embodiments, the predetermined threshold of Cu concentration is between about 10 grams/Liter to about 50 grams/Liter. In some embodiments, the jet array sprays the fluid at a strain rate of about 20,000 to about 30,000 per second. In some embodiments, the jet array sprays the fluid at a flow rate of about 0.01 gpm to about 0.05 gpm per aperture of the plurality of apertures.

In block 1210, the jets formed through the first plurality of apertures cease spraying.

In block 1215, the substrate is sprayed with jets formed through only the second plurality of apertures. In some embodiments, the jet array sprays the fluid onto a substrate. In some embodiments, spraying the substrate increases a deposition rate of a deposited Cu onto the substrate. In some embodiments, the deposition rate is about 0.5 μm/min to about 3 μm/min. In some embodiments, the predetermined threshold of Cu concentration is between about 10 grams/Liter to about 50 grams/Liter. In some embodiments, the jet array sprays the fluid at a strain rate of about 5,000 to about 30,000 per second. In some embodiments, the jet array sprays the fluid at a flow rate of about 0.01 gpm to about 0.05 gpm per aperture of the plurality of apertures.

It should be understood that all methods 1000, 1100, and 1200 should be interpreted as merely representative. In some embodiments, process blocks of all methods 1000, 1100, and 1200 may be performed simultaneously, sequentially, in a different order, or even omitted, without departing from the scope of this disclosure.

The present application may reference quantities and numbers. Unless specifically stated, such quantities and numbers are not to be considered restrictive, but representative of the possible quantities or numbers associated with the present application. Also, in this regard, the present application may use the term "plurality" to reference a quantity or number. In this regard, the term "plurality" is meant to be any number that is more than one, for example, two, three, four, five, etc. The terms "about," "approximately," "near," etc., mean plus or minus 5% of the stated value. For the purposes of the present disclosure, the phrase "at least one of A, B, and C," for example, means (A), (B), (C), (A and B), (A and C), (B and C), or (A, B, and C), including all further possible permutations when greater than three elements are listed.

The detailed description set forth above in connection with the appended drawings, where like numerals reference like elements, are intended as a description of various embodiments of the present disclosure and are not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result. Generally, the embodiments disclosed herein are non-limiting, and the inventors contemplate that other embodiments within the scope of this disclosure may include structures and functionalities from more than one specific embodiment shown in the figures and described in the specification.

In the foregoing description, specific details are set forth to provide a thorough understanding of exemplary embodiments of the present disclosure. It will be apparent to one skilled in the art, however, that the embodiments disclosed herein may be practiced without embodying all the specific details. In some instances, well-known process steps have not been described in detail in order not to unnecessarily obscure various aspects of the present disclosure. Further, it will be appreciated that embodiments of the present disclosure may employ any combination of features described herein.

The present application may include references to directions, such as "vertical," "horizontal," "front," "rear," "left," "right," "top," and "bottom," etc. These references, and other similar references in the present application, are intended to assist in helping describe and understand the particular embodiment (such as when the embodiment is positioned for use) and are not intended to limit the present disclosure to these directions or locations.

The present application may also reference quantities and numbers. Unless specifically stated, such quantities and numbers are not to be considered restrictive, but exemplary of the possible quantities or numbers associated with the present application. Also, in this regard, the present application may use the term "plurality" to reference a quantity or number. In this regard, the term "plurality" is meant to be any number that is more than one, for example, two, three, four, five, etc. The term "about," "approximately," etc., means plus or minus 5% of the stated value. The term "based upon" means "based at least partially upon."

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

While illustrative embodiments have been illustrated and described, it will be appreciated that various changes can be made therein without departing from the spirit and scope of the invention.

What is claimed is:

1. An electroplating system for a substrate, comprising:

a Cu bath disposed within a vessel, the Cu bath being characterized by a predetermined threshold of Cu concentration and a predetermined threshold of acid concentration, wherein the substrate is submerged in the Cu bath; and a jet array configured for increasing a strain rate of a fluid being sprayed onto the substrate, wherein the fluid has a same composition as the Cu bath, wherein the jet array comprises a plurality of apertures disposed on a plate, and wherein the plate is a first plate and the plurality of apertures is a first plurality of apertures, and wherein the jet array further comprises a second plate coupled with the first plate on a bottom side of the first plate, and a second plurality of apertures, wherein an outlet end of each of the first plurality of apertures and each of the second plurality of apertures extends through a top surface of the first plate, an inlet end of each of the first plurality of apertures extends through a bottom surface of the first plate, and an inlet end of each of the second plurality of apertures extends through a bottom surface of the second plate.

2. The electroplating system of claim 1, wherein the predetermined threshold of Cu concentration is between about 10 grams/Liter to about 60 grams/Liter.

3. The electroplating system of claim 2, wherein the predetermined threshold of Cu concentration is between about 40 grams/Liter to about 60 grams/Liter.

4. The electroplating system of claim 1, wherein the jet array is configured to spray fluid with a strain rate of about 5,000 to about 30,000 per second.

5. The electroplating system of claim 1, wherein the jet array sprays the fluid at a flow rate of about 0.01 gpm to about 0.05 gpm per aperture of the plurality of apertures.

6. The electroplating system of claim 1, wherein:

a diameter of each of the plurality of apertures is no greater than 1 mm.

7. A method of electroplating by an electroplating system, the system comprising a spray jet array, and a copper (Cu) bath, wherein the Cu bath is characterized by a predetermined threshold of Cu concentration, and a predetermined threshold of acid concentration, the method comprising:

spraying a fluid onto a substrate with the jet array, wherein the fluid has a same composition as the Cu bath and wherein spraying the substrate increases a deposition rate of a deposited Cu onto the substrate, wherein the jet array comprises a plurality of apertures disposed on a plate, wherein the plate is a first plate and the plurality of apertures is a first plurality of apertures, and wherein the jet array further comprises a second plate coupled with the first plate on a bottom side of the first plate, and a second plurality of apertures, wherein an outlet end of each of the first plurality of apertures and each of the second plurality of apertures extends through a top surface of the first plate, an inlet end of each of the first plurality of apertures extends through a bottom surface of the first plate, and an inlet end of each of the second plurality of apertures extends through a bottom surface of the second plate;

depositing Cu onto the substrate while the jet array is spraying the Cu bath, wherein the predetermined threshold of acid concentration increases a bath conductivity of the Cu bath, and wherein the increased bath conductivity improves a coplanarity of copper structures being deposited on the substrate;

spraying the substrate with jets formed through only the first plurality of apertures;

ceasing to spray the substrate with jets formed through the first plurality of apertures; and spraying the substrate with jets formed through only the second plurality of apertures.

8. The method of claim 7, wherein the predetermined threshold of Cu concentration is between about 10 grams/Liter to about 60 grams/Liter.

9. The method of claim 7, wherein the Cu bath conductivity is between about 400 mS/cm and about 800 mS/cm.

10. The method of claim 8, wherein the predetermined threshold of Cu concentration is between about 40 grams/Liter to about 60 grams/Liter.

11. The method of claim 1, further comprising:

depositing Cu until a target deposit is reached.

12. The method of claim 7, wherein the target deposit is between about 10 μm and about 100 μm.

13. The method of claim 7, wherein the deposited Cu has an aspect ratio of about 0.4 to about 20.

14. The method of claim 7, wherein the jet array sprays the fluid at a strain rate of about 5,000 to about 30,000 per second.

15. The method of claim 7, wherein the electroplating system further comprises a head that is configured to hold the substrate, the method further comprising:

placing the substrate onto the head;

submerging the substrate in the Cu bath; and positioning the head to a plating position.

16. The method of claim 6, wherein the jet array sprays the fluid at a flow rate of about 0.01 gpm to about 0.05 gpm per aperture of the plurality of apertures.

* * * * *